US006118417A

United States Patent [19]

Hush

[11] Patent Number: 6,118,417

[45] **Date of Patent: *Sep. 12, 2000**

[54] FIELD EMISSION DISPLAY WITH BINARY ADDRESS LINE SUPPLYING EMISSION CURRENT

[75] Inventor: Glen E. Hush, Boise, Id.

[73] Assignee: Micron Technology, Inc., Boise, Id.

[ * ] Notice: This patent issued on a continued prosecution application filed under 37 CFR 1.53(d), and is subject to the twenty year patent term provisions of 35 U.S.C. 154(a)(2).

[21] Appl. No.: 08/551,780

[22] Filed: Nov. 7, 1995

[51] Int. Cl.[7] ..... G09G 3/06

[52] U.S. Cl. ..... 345/74; 313/495

[58] Field of Search ..... 345/74, 75, 79, 345/147, 88, 30, 173, 55, 169.1; 349/139; 315/169.3, 167, 349, 334; 313/495

[56] References Cited

U.S. PATENT DOCUMENTS

| | | | |
|---|---|---|---|
| 4,229,766 | 10/1980 | Sipos | 345/75 |
| 4,743,096 | 5/1988 | Wakai et al. | 350/333 |
| 4,857,799 | 8/1989 | Spindt | 313/495 |
| 4,866,349 | 9/1989 | Weber et al. | 315/169.4 |
| 4,908,539 | 3/1990 | Meyer | 315/169.3 |
| 4,924,215 | 5/1990 | Nelson | 345/75 |
| 5,036,317 | 7/1991 | Buzak | 340/783 |
| 5,075,596 | 12/1991 | Young et al. | 315/169.3 |
| 5,103,144 | 4/1992 | Dunham | 315/366 |
| 5,153,483 | 10/1992 | Kishino et al. | 315/3 |
| 5,157,309 | 10/1992 | Parker | 315/169.1 |
| 5,210,472 | 5/1993 | Casper et al. | 315/349 |
| 5,262,698 | 11/1993 | Dunham | 315/169.1 |
| 5,313,140 | 5/1994 | Smith | 315/169.1 |
| 5,357,172 | 10/1994 | Lee et al. | 315/167 |
| 5,359,256 | 10/1994 | Gray | 313/169 |
| 5,387,844 | 2/1995 | Browning | 315/169.3 |
| 5,402,041 | 3/1995 | Kishino et al. | 315/169.1 |
| 5,404,081 | 4/1995 | Kane et al. | 345/169.1 |
| 5,410,218 | 4/1995 | Hush | 315/169.1 |
| 5,475,396 | 12/1995 | Kitajima | 345/92 |
| 5,555,000 | 9/1996 | Sarrasim et al. | 345/75 |
| 5,581,159 | 12/1996 | Lee et al. | 315/167 |
| 5,598,156 | 1/1997 | Hush et al. | 341/100 |
| 5,616,991 | 4/1997 | Casper et al. | 315/167 |
| 5,631,664 | 5/1997 | Adachi et al. | 345/74 |
| 5,638,085 | 6/1997 | Hush et al. | 345/74 |
| 5,638,086 | 6/1997 | Lee et al. | 345/74 |
| 5,642,017 | 6/1997 | Hush | 345/74 |
| 5,783,910 | 7/1998 | Casper et al. | 315/167 |

FOREIGN PATENT DOCUMENTS

| | | | |
|---|---|---|---|
| 0 381 479 | 8/1990 | European Pat. Off. | G09G 3/30 |
| 92/05571 | 4/1992 | WIPO . | |

*Primary Examiner*—Jeffery Brier
*Attorney, Agent, or Firm*—Robert J. Stern

[57] ABSTRACT

The present invention enables a reduction in the number of electrical conductors which must be connected to each pixel in a field emission display. A first feature of the invention is that the functions of a conventional power supply ground conductor and a conventional "row enable" logic signal conductor are combined in a single "inverted row enable" logic signal conductor for each display row. A second feature is that the functions of a conventional "column enable" logic signal conductor and a conventional luminance signal conductor are combined in a "column luminance" signal conductor for each display column. The first feature is implemented by connecting the "inverted row enable" logic signal conductor as the source of emitter tip current for all the pixels in a display row. The second feature is implemented by gating (logically ANDing) a luminance signal by a "column enable" logic function to create a column luminance signal for each display column. The current flow through the emitter tips of each pixel, and hence the luminance of each pixel, is controlled by a transistor connected in series between the emitter tips of that pixel and the "row enable" signal conductor for the display row containing that pixel. The gate of the transistor connects to a conductor carrying the "column luminance" signal for the display column containing that pixel.

56 Claims, 10 Drawing Sheets

FIELD EMISSION DISPLAY WITH BINARY ADDRESS LINE SUPPLYING EMISSION CURRENT

This invention was made with Government support under Contract no. DABT63-93-C-0025 awarded by Advanced Research Projects Agency ("ARPA"). The Government has certain rights in this invention.

FIELD OF THE INVENTION

The invention relates generally to field emission displays and, more specifically, to circuitry for connecting appropriate video luminance signals to different pixels in such a display.

BACKGROUND OF THE INVENTION

Field emission displays are desirable for use in viewfinders of video cameras and other display applications requiring low operating power and high pixel density. Such displays typically include an anode electrode coated with an cathodoluminescent phosphor, an array of field emitter tip cathode electrodes, and a perforated grid or gate electrode adjacent the emitter tips. A high positive voltage (e.g., +1,000 volts) is connected to the anode, and a lower positive voltage (e.g., +50 v.) is connected to the grid.

A pixel is the smallest independently-controllable area of the display. Each pixel includes a number of emitter tips which are controlled together. A typical field emission display has an array of tens of thousands of pixels arranged in a matrix of hundreds of rows and hundreds of columns, so that each pixel is uniquely identified by the row and column to which it belongs.

A field emission display may be "active matrix" or "passive matrix". In an active matrix field emission display, each pixel includes a control circuit connected to the emitter tips in that pixel which controls the voltage at the emitter tips and the current flow through the tips. The emitter tips and control circuit are replicated at each of the thousands of pixels in the display.

In operation, when a pixel is to be dark, that pixel's control circuit raises the voltage at that pixel's emitter tips to a value high enough that the difference between the emitter tip voltage and the grid voltage is less than the voltage required to initiate a field emission discharge from the emitter tips. Conversely, when a pixel is to emit light, the pixel's control circuit reduces the voltage at the emitter tips to a value sufficiently lower than the grid voltage (i.e., the control circuit makes the emitter tip voltage sufficiently negative relative to the grid electrode voltage) so as to cause field emission of electrons from the emitter tips. Each emitter tip emits electrons toward the grid, but almost all the electrons are accelerated by the anode voltage so as to pass through apertures in the grid and strike the phosphor coating on the anode, thereby exciting the phosphor to emit light.

An example of an active matrix field emission display is disclosed in commonly-assigned U.S. Pat. 5,357,172 to Lee et al., entitled "Current-Regulated Field Emission Cathodes for Use in a Flat Panel Display in Which Low-Voltage Row and Column Address Signals Control a Much Higher Pixel Activation Voltage".

In a raster scan video system, an analog or digital video luminance signal is produced by scanning the brightness of the video image from the left-most column to the right-most column within the top row of the image, then scanning from left to right within the next lower row, and so forth until the bottom row of the image is scanned. At this point the scanning process is repeated. At any instant, the value of the video luminance signal is proportional to the brightness of the pixel at the current scan position.

The video signal in a raster scan system includes both the luminance signal and a synchronization signal from which the current scan position can be derived. A video decoder circuit in the display receives the video signal and typically generates from it row select and column select logic signals which respectively identify, at any instant, the row and column coordinates of the current pixel, that is, the pixel whose luminance is represented by the instantaneous value of the video luminance signal.

In order to pack as many pixels as possible within a given substrate area, it is desirable to minimize the amount of circuitry which must be fabricated at the site of each pixel. Generally, the pixels are fabricated on a certain area of a substrate, and the video decoder circuit is fabricated on the substrate outside the pixel area. Consequently, electrical conductors must be fabricated on the substrate to connect each pixel to the video decoder circuit and to a source of electrical current (such as electrical ground). Many conventional designs require four conductors connecting each pixel to a binary row enable signal, a binary column enable signal, a luminance signal, and electrical ground, respectively.

Such a large number of electrical conductors connecting each pixel to the video decoder and to a source of electrical power occupies substantial space on the pixel area of the substrate, thereby limiting how closely the pixels can be spaced together. There is a need for a design enabling a display to be manufactured with a minimal number of electrical conductor lines connecting to each pixel and, preferably, a minimal number of electrical devices fabricated at each pixel site on the substrate.

SUMMARY OF THE INVENTION

The present invention enables a reduction in the number of electrical conductors which must be connected to each pixel in a field emission display. The invention applies to displays having pixels arranged in a matrix of rows and columns, so that each intersection of a row and a column constitutes one pixel.

A first feature of the invention is that the functions of a conventional power supply ground conductor and a conventional "row enable" logic signal conductor are combined in a single "inverted row enable" logic signal conductor for each display row. A second feature is that the functions of a conventional "column enable" logic signal conductor and a conventional luminance signal conductor are combined in a "column luminance" signal conductor for each display column.

The first feature is implemented by connecting the "inverted row enable" logic signal conductor as the source of emitter tip current for all the pixels in a display row. The second feature is implemented by gating (logically ANDing) a luminance signal by a "column enable" logic function to create a column luminance signal for each display column. The current flow through the emitter tips of each pixel, and hence the luminance of each pixel, is controlled by a transistor connected in series between the emitter tips of that pixel and the "row enable" signal conductor for the display row containing that pixel. The gate of the transistor connects to a conductor carrying the "column luminance" signal for the display column containing that pixel.

Advantageously, the row conductor and the column luminance conductor are the only conductors required to connect each pixel to other portions of the display such as the video decoder and the power supplies. A further advantage is that only a single transistor need be fabricated at each pixel site on the substrate. By reducing the number of conductors required to run between pixel sites, and by reducing the number of transistors required at each pixel site, the invention enables a field emission display to be produced with higher pixel densities, improved manufacturing yields, and reduced manufacturing costs.

DETAILED DESCRIPTION OF THE PREFERRED EMBODIMENTS

1. Pixel Arrangement and Circuitry

Figure 1:
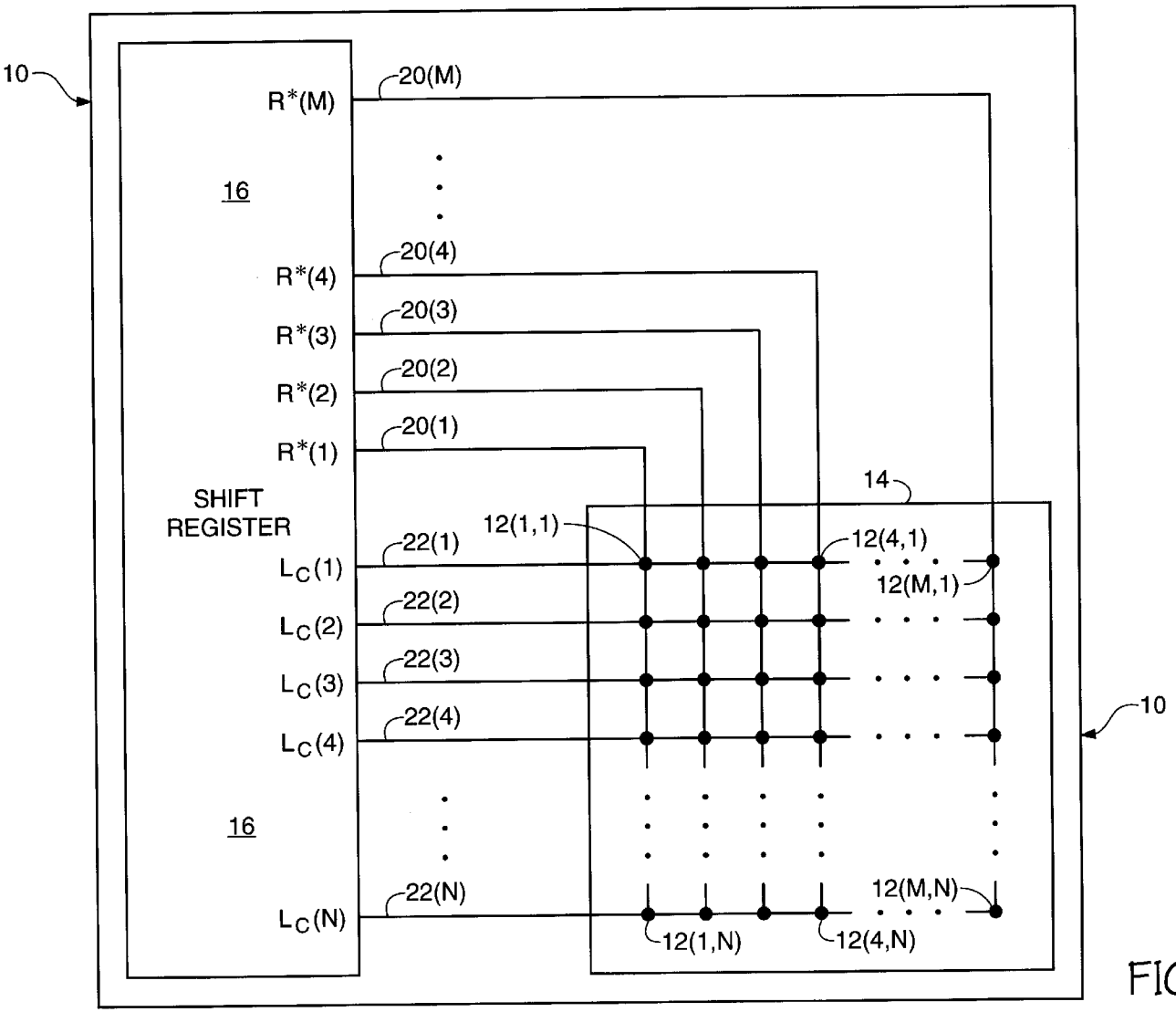
FIG. 1 is a top view of a substrate embodying the preferred embodiment of the invention, showing the layout of the row enable and column luminance conductors.

FIG. 1 shows a silicon substrate 10 on which a display according to the invention has been fabricated. The display pixels 12 are fabricated within a first rectangular area 14 of the substrate. The pixels are arranged on the substrate in a rectangular M×N matrix of orthogonal rows and columns, where M and N are the number of rows and columns, respectively, so that the total number of pixels is M times N. In a commercially useful display, there would be tens of thousands of pixels arranged in hundreds of rows and columns, but, for simplicity, FIG. 1 shows only the first four rows and columns, the last (M-th) row, and the last (N-th) column.

A second area 16 of the substrate contains the circuitry for decoding the video input signal and providing electrical power to the pixels. The pixels 12 are connected to the video and power circuit 16 by M "inverted row enable" conductor lines 20(1), 20(2), 20(3), . . . 20(M) and N "column luminance" conductor lines 22(1), 20(2), 20(3), . . . 20(N).

The inverted row enable lines 20 are mutually parallel and extend horizontally across the first area 14 containing the pixels, there being one row line for each row of pixels 12. Similarly, the column luminance lines 22 are mutually parallel and extend vertically across the first area 14 containing the pixels, there being one column line for each column of pixels 12. Each pixel 12, represented by each dark circle or dot in FIG. 1, is located at the intersection of an inverted row enable line 20 with a column luminance line 22. Each pixel includes one or more field emitter tip cathode electrodes 18 (shown in FIG. 2).

Figure 2:
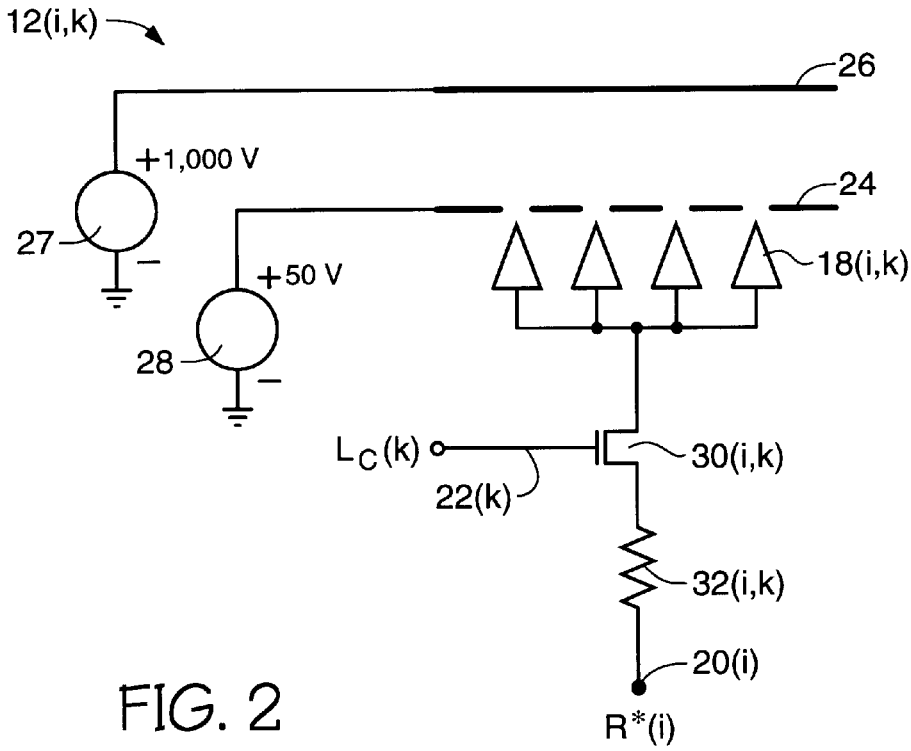
FIG. 2 is an electrical schematic of a pixel current control circuit at each pixel.

FIG. 2 shows the circuitry at the site of an illustrative pixel 12(i,k) located at the intersection of the i-th row and the k-th column of the display, where i is any integer from 1 to M, and k is any integer from 1 to N. The pixel is shown as having four field emitter tips 18, although, as stated above, each pixel can have only one emitter tip or any other number of emitter tips 18. A grid or gate electrode 24 extends across the entire upper surface of the substrate 10 and has an aperture surrounding or just above each emitter tip 18. The grid 24 is connected to a grid voltage source 28 which supplies to the grid a positive voltage (for example, +50 volts) great enough relative to the voltage on the emitter tips 18 to start an electrical discharge in the gap between the emitter tip 18 and the grid 24. An anode 26 is coated with an cathodoluminescent phosphor and is connected to an anode voltage source 27 which supplies a much higher, positive voltage, such as 1,000 volts. Electrons emitted from the emitter tips 18 due to the electrical discharge are accelerated by the high anode voltage so that most of the electrons travel past the grid and impact the anode, thereby exciting the phosphor to emit light. All of the components described in this paragraph are conventional, and can be designed in accordance with known design principles for field emission displays.

In each pixel 12(*i,k*), the emitter tips of that pixel are connected to the drain of an N-channel field-effect transistor (FET) 30(*i,k*) whose source is connected, through a resistor 32(*i,k*), to the inverted row enable line 20(*i*) which intersects that pixel. The gate of the transistor is connected to the column luminance line 22(*k*) which intersects that pixel.

The FET 30 is characterized by a threshold voltage $V_T$ such that the FET 30 does not conduct current between its source and drain when $V_{GS}$ (the FET's gate voltage $V_G$ minus the FET's source voltage $V_S$) is less than $V_T$. Conversely, when $V_{GS}$ exceeds $V_T$, the channel resistance of the FET 30—i.e., the resistance between the source and the drain-sharply drops to a value orders of magnitudes less than the resistance of the resistor 32.

The column luminance signal $L_C$ on each of the N column luminance lines 22 is a low voltage (preferably zero volts) when that column is disabled or deselected, and it is an analog value proportional to the luminance of the pixel when the column is enabled or selected. The k-th column luminance signal $L_C$(k) on column line 22(*k*) connects to the gate of the transistor 30(*i,k*) of each pixel in the k-th column. As will be explained in more detail below, higher voltage values of the luminance signal $L_C$ decrease the channel resistance of the field-effect transistor 30, thereby increasing the current flow through the emitter tips 18, and thereby increasing the luminance of the pixel. In the illustrated preferred embodiment, the maximum value $L_{C(max)}$ of the luminance signal, corresponding to maximum pixel luminance, is +5 volts.

In the presently preferred embodiment, each column is enabled successively, one column at a time, and the column luminance signal $L_C$ is low on all other columns. In an alternative embodiment explained in more detail below, the column luminance signal $L_C$ is buffered so that all columns become enabled simultaneously when each successive row is enabled, and all columns remain enabled for the entire period each row is enabled.

The binary logic signal R* on each of the M row enable lines 20 is an inverted row enable signal. That is, its value is a low voltage $R^*_{(low)}$ (preferably zero volts) when the pixels in that row are selected or enabled, and a high voltage $R^*_{(high)}$ (for example, +50 volts) otherwise, i.e., when that row is unselected or disabled. Specifically, the high voltage $R^*_{(high)}$ corresponding to an unselected or disabled row should be greater than the maximum amplitude of the luminance signal $L_C$ minus the threshold voltage $V_T$ of the FET 30, that is, $R^*_{(high)}>[L_{C(max)}$31 $V_T]$. This assures that when the inverted row enable signal R* is high, current flow through the channel of FET 30 will be turned off because $V_{GS}<V_T$. In the illustrated preferred embodiment, $R^*_{(low)}=0$, $R^*_{(high)}=+50$ volts, $L_{C(max)}=+50$ volts, and $V_T=1$ volt, hence $[L_{C(max)}-V_T]=+4$ volts, thereby satisfying the stated requirement that $R^*_{(high)}>[L_{C(max)}-V_T]$.

During times when the row containing a given pixel 12(*i,k*) is disabled (i.e., not selected), the binary inverted row signal R*(i) connected to that row is high ($R^*(i)=R^*_{(high)}$), thereby turning off current flow between the source and drain of transistor 30(*i,k*). Consequently, no current can flow to the emitter tips 18(*i,k*) in that pixel.

Conversely, during times when the row containing a given pixel 12(*i,k*) is enabled (i.e., selected), the binary inverted row signal R*(i) connected to that row is low ($R^*(i)=R^*_{(low)}$), and the luminance signal $L_C(k)$ controls the current flow to the emitter tips 18(*i,k*) as follows: During times when the k-th luminance signal is low, specifically, when $L_C(k)<(V_T+R^*_{(low)})$, the transistor 30(*i,k*) will be turned off (i.e., will have a very high channel resistance) so as to prevent current flow to the emitter tips 18(*i,k*). Conversely, during times when the luminance signal is high, specifically, when $L_C(k)>(V_T+R^*_{(low)})$, the channel resistance of the FET 30(*i,k*) drops to a value orders of magnitude less than the resistance of the resistor 32(*i,k*). In this condition, the FET 30(*i,k*) functions as a voltage regulator, maintaining its source voltage $V_S(i,k)$ at a level equal to the luminance signal voltage $L_C(k)$ minus the threshold voltage $V_T$ (i.e., maintaining $V_S=L_C-V_T$). Thus, the voltage $V_R(i,k)$ across the resistor 32(*i,k*) equals $V_S(i,k)$ minus $R^*_{(low)}$; that is, the voltage $V_R(i,k)$ across the resistor 32(*i,k*) equals $[L_C(k)-(V_T+R^*_{(low)})]$. Therefore, the FET 30(*i,k*) applies a voltage $V_R(i,k)$ across the resistor 32(*i,k*) which is directly proportional to the luminance voltage $L_C(k)$.

In response to the voltage $V_R$ across the resistor 32, the current through the resistor 32 is $V_R$ divided by the resistance R of the resistor. The path from the row enable line R* through the resistor 32 is the only source of current flow to the emitter tips 18. Therefore, the transistor 30 and resistor 32 regulate the current flow to the emitter tips 18, in response to the column luminance signal $L_C$, as equal to $[L_C-(V_T+R^*_{(low)})]/R$.

To summarize the operation of the pixel control circuit 12 shown in FIG. 2, for the pixel 12(*i,k*) located at the intersection of the i-th row and the k-th column, the FET 30(*i,k*) turns off current flow to the emitter tips 18(*i,k*) during times when the i-th row is unselected (R*(i) is high) or when the k-th column luminance voltage signal is low ($L_C(k)<V_T+R^*_{(low)}$). Conversely, during times when the i-th row is selected (R*(i) is low) and the k-th luminance signal is high ($L_C(k)>V_T+R^*_{(low)}$), the current flow to the emitter tips 18(*i,k*) is proportional to the luminance signal $L_C(k)$; specifically, the emitter tip current in that pixel is $[L_C(k)-(V_T+R^*_{(low)})]/R$.

2. Video Decoder Circuitry

Figure 3:
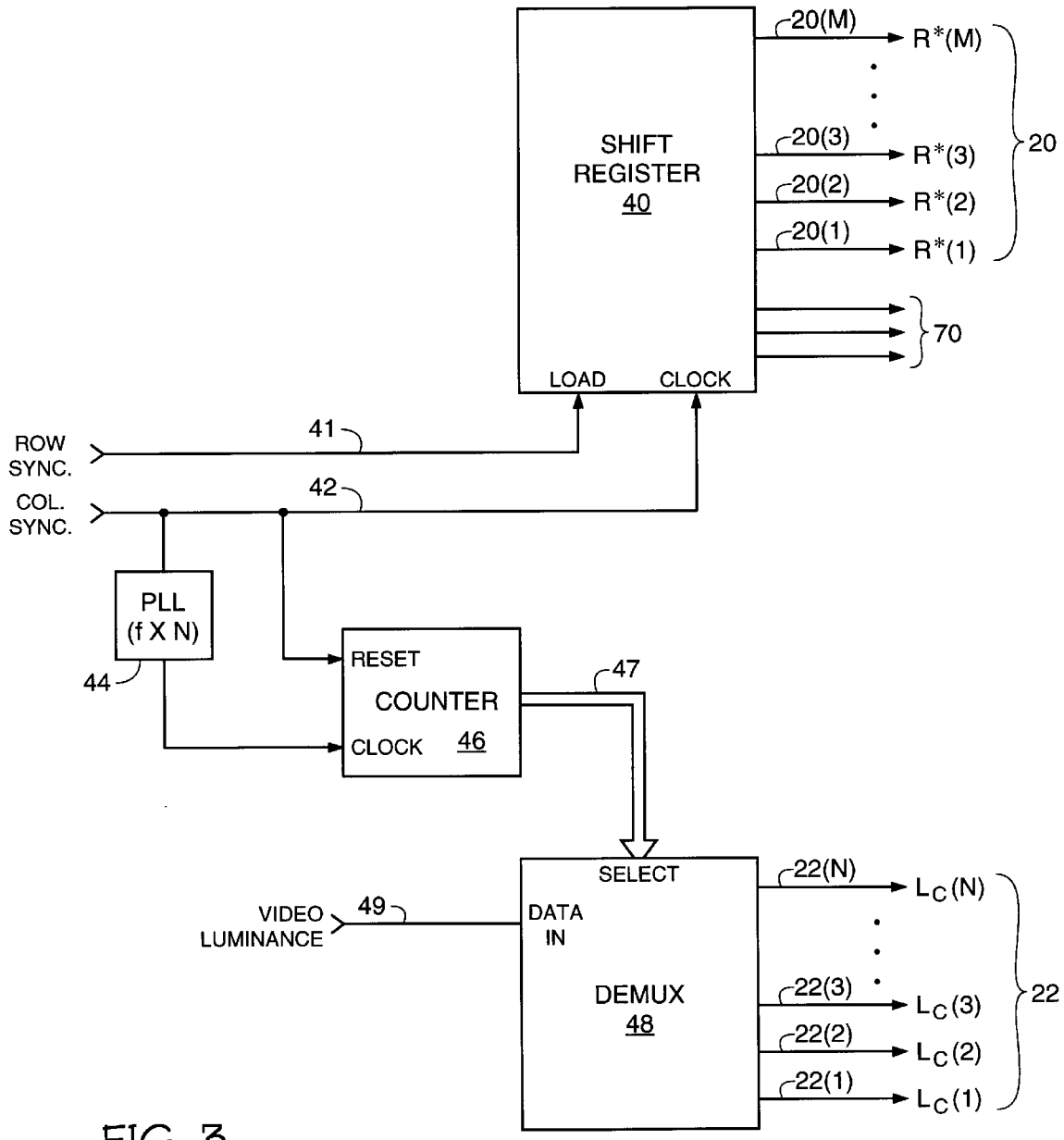
FIG. 3 is a block diagram of the portions of a video decoder circuit which generate inverted row enable signals and column luminance signals.

FIG. 3 shows suitable video decoder circuitry for generating the inverted row enable signals R*(1)–R*(M) and the column luminance signals $L_C(1)$–$L_C(N)$.

In a raster scan video system, an analog or digital video luminance signal is produced by scanning the brightness of the video image from the left-most column to the right-most column within the top row of the image, then scanning from left to right within the next lower row, and so forth until the bottom row of the image is scanned. At this point the scanning process is repeated. At any instant, the value of the video luminance signal is proportional to the brightness of the pixel at the current scan position.

The video signal typically is encoded with two timing or synchronization signals: a vertical sync or Row Sync signal, which has a pulse before the scanning of the top row begins; and a horizontal sync or Column Sync signal, which has a pulse before the scanning of each successive row begins, that is, before the scanning of the first column begins. The Column Sync signal has a frequency equal to the frequency of the Row Sync signal multiplied by the number (M) of rows in the video image, or half this value in the case of an interlaced video signal. (If the video signal includes a "vertical retrace" delay between scanning the last row and then scanning the first row, as described below, the period of the Row Sync signal is increased by the vertical retrace delay period, hence the frequency of the Column Sync signal is correspondingly greater than M times the frequency of the Row Sync signal.) Circuits for decoding a video signal to extract a Row Sync signal and a Column Sync signal are well known and are not shown here.

The portion of the video decoder which generates the inverted row enable signals R*(1)–R*(M) includes a conventional shift register 40 having M binary output terminals, where M is the number of rows in the display. The M output terminals of the shift register respectively connect to the M inverted row enable conductor lines 20(1)–20(M) in the display.

The shift register 40 has a Load input terminal 41 which responds to a high voltage or logical "one" binary input signal by loading an initial value into the shift register that produces a low voltage or logical "zero" at the first output terminal 20(1), and a high voltage or logical "one" at each of the other output terminals 20(2), 20(3), . . . 20(M). The Load input terminal 41 is connected to receive the conventional Row Sync signal. Consequently, each time scanning of the first row in the display begins, the shift register is initialized so that the inverted row enable signal R* is low on the first row enable line 20(1), and is high on each of the other row enable lines 20(2), 20(3), . . . 20(M).

The shift register 40 also has a Clock input terminal 42. The output of the shift register shifts by one position in response to each pulse received at the Clock input terminal. The Clock input is connected to receive the conventional Column Sync signal. Consequently, each time the scanning of the next successive row begins, the shift register shifts its output by one position, so that the next successive row enable line 20 has a "low" inverted row enable signal R*, and the other row enable lines 20 have a "high" inverted row enable signal.

The portion of the video decoder circuit which generates the column luminance signals $L_C(1)$–$L_C(N)$ includes a phase locked loop (PLL) circuit 44, a counter 46, and a demultiplexer 48, all conventional. The phase locked loop circuit 44 receives the Column Sync signal and multiplies its frequency by a predetermined number to produce a Column Clock periodic pulse train signal whose period equals the time period between the scanning of one column and the next. In other words, the Column Clock signal has a pulse each time the video luminance signal changes to represent the next pixel (i.e., the next column) within a display row.

The predetermined number by which the PLL multiplies the frequency of the Column Sync signal equals N, the number of columns in each display row, if there is no "horizontal retrace" delay between scanning the last column of one row and the first column of the next row. However, if there is a horizontal retrace delay, as explained in more detail below, the predetermined number would be increased proportionately.

The Column Clock signal is connected to the Clock input of a conventional counter 46. The counter generates at its output 47 a binary number which increments in response to each pulse of the Column Clock signal. The number of bits in the counter output 47 is an integer greater than or equal to $\log_2(N)$, where N is the number of columns. The Column Sync signal is connected to a Reset input of the counter 46, so that the counter output 47 is reset to zero at each pulse of the Column Sync signal, that is, each time the scanning of the next successive display row begins.

The output 47 of the counter 46 is connected to the Select input of a conventional 1:N (one-to-N) demultiplexer 48. The demultiplexer has N analog outputs which are respectively connected to the N column luminance lines 22(1)–22 (N). The demultiplexer 48 has one analog Data input 49 which is connected to receive the analog video luminance signal. (If the original video luminance signal is digital, it should be converted to analog by a conventional digital-to-analog converter before connecting it to the input of the demultiplexer 48.) The demultiplexer transfers the analog video luminance signal at its Data input 49 to only one of the N outputs 22, with the selection of that one output being determined by the binary number received at the Select input 47 of the demultiplexer. The demultiplexer outputs a zero voltage signal to the other (i.e., unselected) outputs 22.

Consequently, at the time the scanning of a display row begins, the demultiplexer 48 transfers the video luminance signal to the first column luminance line 22(1), that is, to the column luminance line in the first column of the display. As the display row is scanned across successive columns within this row, the video luminance signal is transferred successively to each of the column luminance lines 22. The resulting signal on each column luminance line 22(*k*) is the column luminance signal $L_C(k)$ required by the pixel circuit shown in FIG. 1.

The foregoing description of the video decoder circuit shown in FIG. 3 assumes that the display begins scanning one row immediately after the preceding row has been scanned. However, certain standard formats for video transmission, such as the NTSC format widely used for television video in the U.S., dictate a "horizontal retrace" or "column retrace" delay between scanning the last column of one row scan and the first column of the next row, as well as a "vertical retrace" or "row retrace" delay between scanning the last row and returning to scan the first row. The vertical sync or Row Sync signal would be encoded in the video signal at a predetermined time during the vertical retrace period, and the horizontal sync or Column Sync would appear at a predetermined time during the horizontal retrace period.

To accommodate the vertical retrace delay, the shift register 40 shown in FIG. 3 can include additional shift stages. Specifically, a number of shift register stages 70 would be added before the stage connected to row line R*(1) to accommodate the delay between the Row Sync signal and the scanning of the first row.

Similarly, to accommodate the horizontal retrace delay, the counter 46 can be programmed to reset its count to a predetermined negative number, rather than to zero, in response to each Column Sync signal. The negative number would be chosen in proportion to the delay between the Column Sync signal and the beginning of the scan of the first column.

3. Substrate Layout and Fabrication

Figure 4:
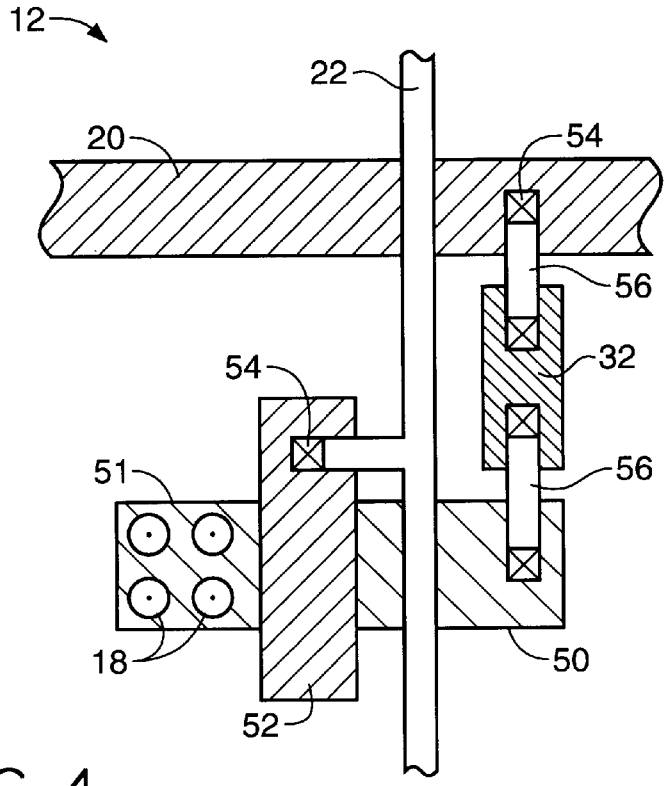
FIG. 4 is a top view of a substrate on which the control circuit of FIG. 2 is fabricated.

FIG. 4 shows how the pixel circuit 12 shown in FIG. 2 is fabricated at each pixel site on a silicon substrate, and how each pixel circuit is connected to the inverted row enable conductor lines 20 and the column luminance conductor lines 22. While the following process description is merely one example of how the present invention can be implemented, it illustrates how the invention can be fabricated with fewer layers than conventional designs, namely, one N-doped active layer in the silicon substrate, one polysilicon layer, and one metal layer.

The silicon substrate is lightly P-doped (i.e., $P^-$). Four conical field emitter tips 18 are fabricated on the substrate surface by etching the substrate immediately surrounding the desired locations of the tips. The process of fabricating the tips 18 is described in commonly-assigned U.S. Pat. No. 5,151,061 issued Sep. 29, 1992 to Sandhu, commonly-assigned U.S. Pat. No. 5,229,331 issued Jul. 20, 1993 to Doan et al., and commonly-assigned U.S. Pat. No. 5,391,259 issued Feb. 21, 1995 to Cathey et al., the entire contents of all three of which are hereby incorporated into this patent application. Other methods of fabricating conical field emitter tips also are well known in the field emission display art.

A silicon dioxide dielectric layer (not shown) is grown over the entire substrate. Only a very thin dielectric layer is grown in the area over each transistor 30, and a thicker dielectric layer is grown elsewhere. The thicker portion of the dielectric is thick enough so that parasitic capacitance between the subsequently deposited polysilicon layers and the substrate will not be excessive.

The very thin dielectric layer grown over each transistor 30 will function as the gate dielectric of the transistor 30 after the gate electrode 52 is deposited in the next process step. (More precisely, the portion of the dielectric which functions as the gate dielectric is only the portion grown over the channel of the transistor 30, that is, the portion of the transistor 30 between the source region 50 and the drain region 51. However, the same very thin dielectric is grown over the entire transistor 30, including the source 50 and drain 51.)

The depth of this very thin dielectric layer is chosen in accordance with the desired characteristics of the transistor 30. This layer also is thin enough so that ions implanted into the source 50 and drain 51 in the subsequent implantation step will penetrate the very thin dielectric layer into the underlying silicon.

A conventional LOCOS process may be used to grow the silicon dioxide layer according to the just described pattern of different thicknesses.

Figure 5:
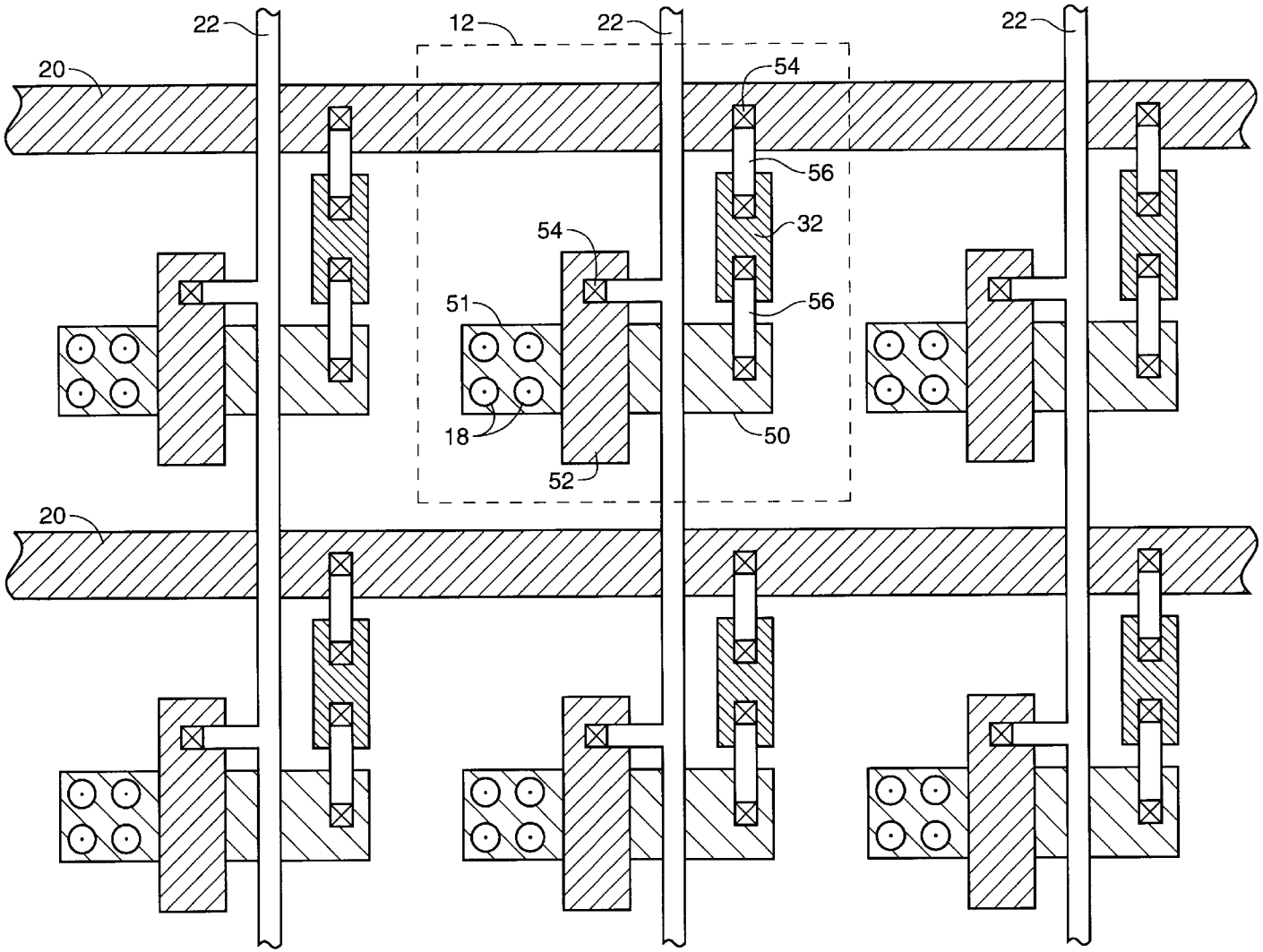
FIG. 5 is a top view of a substrate showing six of the pixels of FIG. 4 and their connections to the inverted row enable line and the column luminance line.

The polysilicon gate 52 is deposited over the FET channel region between the source and drain. Concurrently, a polysilicon layer is deposited in the region 32 which will become the resistor 32. Also concurrently, the polysilicon conductor lines 20 for the inverted row enable signal R* are deposited over the dielectric layer. (More specifically, a blanket polysilicon layer is deposited over the entire substrate, then the unwanted portions are removed by etching.) FIG. 5 shows the inverted row enable lines 20 extending between each row of pixels.

The source and drain regions 50 and 51 then are heavily N-doped (i.e., $N^+$) by ion implantation which penetrates through the thin portion of the dielectric layer, but which does not penetrate through the polysilicon gate 52. The resistor 32 is lightly N-doped so as to produce the desired resistance. (Before implantation, photoresist is deposited and patterned over the areas not to be doped by implantation.)

A second silicon dioxide dielectric layer is deposited over the entire substrate. Via holes are etched in the dielectric where contacts 54 will be formed between any of the doped silicon regions and the metal conductors to be deposited next.

Metal conductor lines 22 for the column luminance signal $L_C$ are deposited over the dielectric so as to extend between each column of pixels, as shown in FIGS. 4 and 5. Each column luminance line 22(*k*) connects to the polysilicon gate 52 of each pixel 12(*i,k*) in the column at a contact region 54.

Simultaneously, metal is deposited to fill the contacts 54 and to form the illustrated short metal lines 56 which connect the resistor 32 between the row enable line 20 and the $N^+$ region 50 at the source electrode of the FET 30.

FIGS. 1 and 5 show how the inverted row enable conductor lines 20 and the column luminance conductor lines 22 are routed on the silicon substrate 10 between the rows and columns of pixels 12 and how they extend between the pixels and the video decoder circuit 16. FIG. 5 shows only a small area of a display occupied by six pixels in two rows and three columns. In a complete display, the layout shown in FIG. 5 is replicated in hundreds of rows and columns.

4. Advantages and Design Optimization

As shown in FIGS. 1 and 5, the inverted row enable lines 20 and the orthogonal column luminance lines 22 are the only conductor lines which traverse the pixel area 14 of the display. This enables the display pixels 12 to be spaced more densely than in other display designs which require connecting all the pixel circuits 12 to a ground line, or which require traversing the pixel area 14 with separate conductor lines for a video luminance signal and a column enable signal. The present invention avoids any need for a ground line traversing the pixel area by using the inverted row enable lines 20 to supply current to the field emitter tips 18. The invention avoids any need for separate luminance and column enable lines to traverse the display area 14 by combining the luminance and column enable information in a single column luminance signal $L_C$ for each column.

As shown in FIGS. 4 and 5, the pixel circuitry of the invention can be fabricated on a silicon substrate with a minimum number of process steps. The only layers which must be deposited on the substrate are: (1) a dielectric layer over the silicon substrate; (2) a polysilicon layer for creating the transistor gate 52, the resistor 32, and the inverted row enable lines 20; (3) a second dielectric layer; and (4) a metal layer for creating column luminance lines 22 and the resistor's interconnect lines 56; plus a final passivation dielectric layer.

A significant advantage of the invention is that the pixel circuit 12 can be fabricated on a silicon substrate with only one metallization layer. Semiconductor fabrication processes for depositing two or more metallization layers are more difficult and expensive than processes for depositing only one metallization layer, primarily because commonly used metals such as aluminum have a low melting temperature, and depositing refractory metals such as titanium is more complex and expensive.

Specifically, although the M row conductor lines 20 and the M column conductor lines 22 could be composed of any conductive material, in the preferred embodiment the row conductor lines 20 are polysilicon, and the column conductor lines 22 are metal. The preferred embodiment uses metal for the column lines 22 because, in a commercially useful display having a few hundred columns of pixels (i.e., N>100), the column luminance signal $L_C$ has a bandwidth a few hundred times (specifically, N times) greater than the bandwidth of the inverted row enable R*. To propagate the full bandwidth of the column luminance signal, the column lines 22 must have an RC time constant whose reciprocal is greater than the bandwidth of the column luminance signal, where R is the resistance per unit length of each column line 22, and C is the parasitic capacitance per unit length between each column line and electrical ground. Because commonly used metal conductors such as aluminum have much lower resistivity than polysilicon conductors, the RC time constant of the column conductor can be advantageously reduced by fabricating the column conductor lines 22 of metal rather than polysilicon.

Since the inverted row enable signals R* carried by the row conductor lines 20 have a few hundred times lower bandwidth than the column luminance signals $L_C$ (specifically, N times lower, where N is the number of columns in the display), a higher resistivity material such as polysilicon can be used to fabricate the row conductor lines 20 while still achieving a sufficiently low RC time constant relative to the bandwidth of the row enable signals R*. Accordingly, the pixel circuit 12 can be fabricated using only one metallization layer.

The relatively high resistivity of polysilicon typically does not impair the ability of the row conductor lines 20 to deliver current to the emitter tips 18, nor does it result in any significant voltage drop across the length of the row lines 20. Even if each row line 20 is several inches long, its resistance typically would be 10 to 100 kilohms. This resistance is negligible compared to the resistance which normally would be used for resistor 32, namely 50 megohms to 50 gigohms.

5. Pixel Current Duty Cycle

In the embodiment of the invention of FIGS. 1–5 as described above, an active (i.e., non-zero) luminance signal $L_C$ is supplied to only one pixel at a time, because an active luminance signal $L_C$ appears on only one of the N column luminance conductor lines 22 at any point in time, and the inverted row enable signal R* is low (i.e., enabled) on only one of the M rows at any point in time. Therefore, the duty cycle of current flow to each pixel cannot exceed the reciprocal of the number of pixels in the display. For example, if the display has ten thousand pixels, the duty cycle of current for each pixel cannot exceed 1/10,000, or 0.01%.

The short duration of the pixel current does not produce perceptible flicker because the duration of light emission from each display pixel is increased by the persistence of the cathodoluminescent phosphor. (As explained earlier, the field emitter tips 18 do not emit light. Rather, they emit electrons which are accelerated by the high voltage on the anode 26 so as to collide with the phosphor coating on the anode, thereby exciting the phosphor to emit light.)

One advantage of supplying current to only one pixel at a time is that the shift register 40 only needs an output current capability high enough to drive a single pixel 12. For example, if the maximum current through a field emitter tip 14 at maximum pixel brightness is 100 nA, and if each pixel has four emitter tips 14, then shift register 42 only needs the capability to supply 400 nA of current.

A potential disadvantage of supplying current to only one pixel at a time is that it limits the maximum brightness of the display. The brightness or luminance of a pixel is proportional to the number of electrons striking the pixel phosphor, which equals the pixel current level multiplied by the pixel current duration. An upper limit to the pixel current is the maximum current that can be conducted through a field emitter tip without risking destruction of the tip from resistive heating. This upper limit probably is on the order of 100 to 500 nA per emitter tip. Providing multiple emitter tips per pixel (four in the illustrated preferred embodiment) proportionately increases the maximum pixel current. I have found that providing a current at maximum brightness of 200 to 400 nA per pixel (50 to 100 nA per emitter tip) is completely satisfactory for a display intended for use in the viewfinder of a video camera. Accordingly, the potential disadvantage of a small pixel current duty cycle has not been a practical disadvantage for camera viewfinder applications.

Conversely, an advantage of the small pixel current duty cycle is that the pixel-to-pixel uniformity of the transconductance of transistors 30, which control the pixel current in response to the column luminance signal $L_C$, is likely to be better when the transistors are operating in the nanoampere current range than in the picoampere range. The latter would be the current flow through the transistors if the duty cycle of the pixel current were somehow raised from 0.01% to 10% and if the instantaneous pixel current were reduced proportionately to achieve the same pixel brightness.

6. Alternative Designs for Higher Pixel Current Duty Cycle a. Alternative with Disabled Column Lines in Floating State The display shown in FIGS. 1–5 can be modified to increase the duty cycle of the pixel current by a factor of close to N; specifically, the duty cycle can be increased from 1/(N*M) to almost 1/M, where M and N are the number of rows and columns, respectively, in the display. In this modification, shown in FIG. 6, the portion of the video decoder which generates the column luminance signals $L_C$ is modified so that unselected output terminals are not set to zero volts as in the previously described embodiment, but are disconnected from any voltage source. The portion of the video decoder shown in FIG. 3 which generates the row enable signals R*—namely, shift register 40—remains the same in the following embodiments and is not depicted in FIG. 6.

Two alternative implementations will be described, followed by a description of their common operating principles.

Figure 6A:
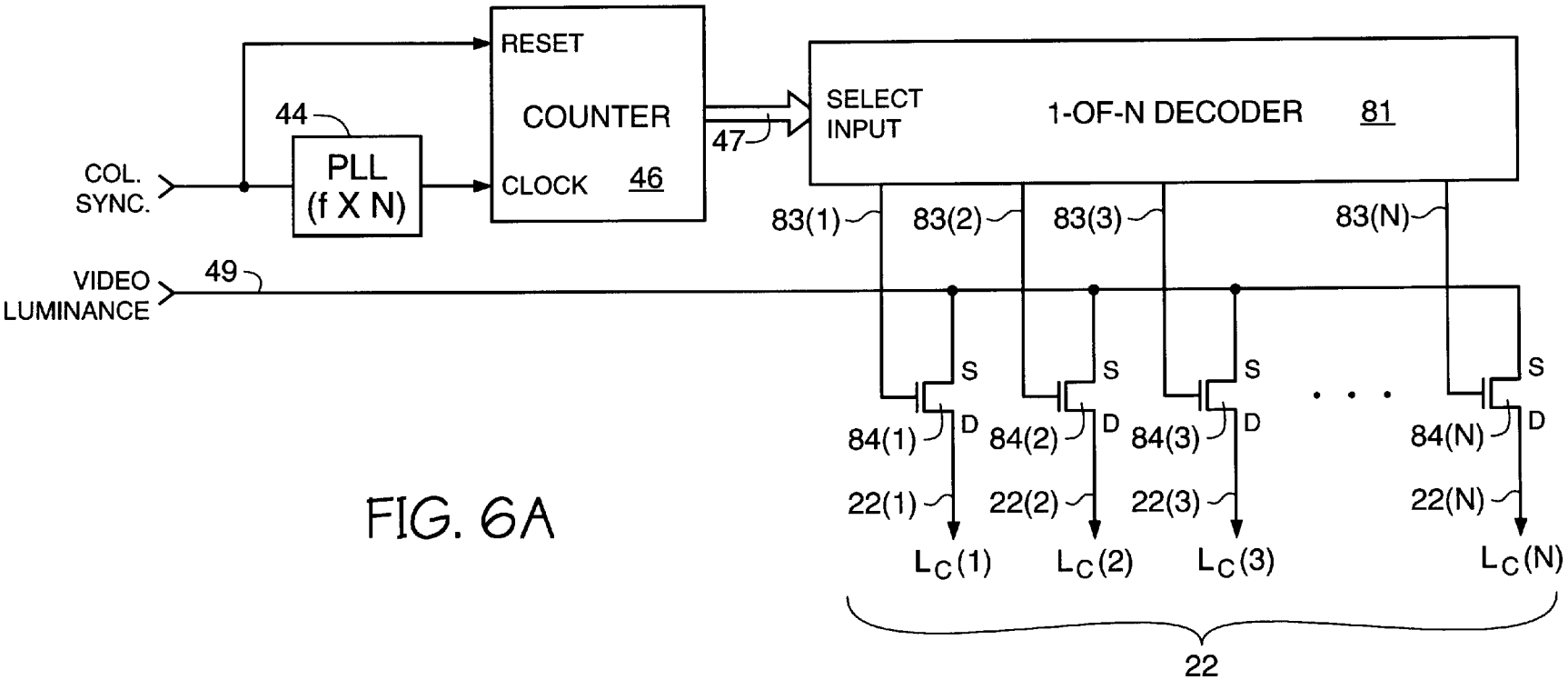
FIGS. 6A and 6B are block diagrams of two alternative implementations of a portion of a video decoder circuit which generates column luminance signals at output lines which are floating when inactive.

In one possible implementation shown in FIG. 6A, the demultiplexer 48 is replaced by a conventional 1-of-N decoder 81 having a multi-bit select input 47 connected to counter 46, and having N outputs 83(1), 83(2), . . . 83(N). The select input 47 determines which one of the N outputs 83 produces a logical "one" or "high" voltage signal; all the other "unselected" outputs 83 produce a logical "zero" or "low" voltage signal. An array of N transistor switches 84(1), 84(2), . . . 84(N) have their gate terminals connected to the respective decoder outputs 83(1), 83(2), . . . 83(N) and have their drain terminals connected to the respective column luminance lines 22(1), 22(2), . . . 22(N). The source terminal of every transistor 84 is connected to receive the video luminance signal 49.

The operation of the PLL 44 and counter 46 are the same as in the FIG. 3 embodiment. The operation of the shift register 81 and the transistors 84 will be described below.

Figure 6B:
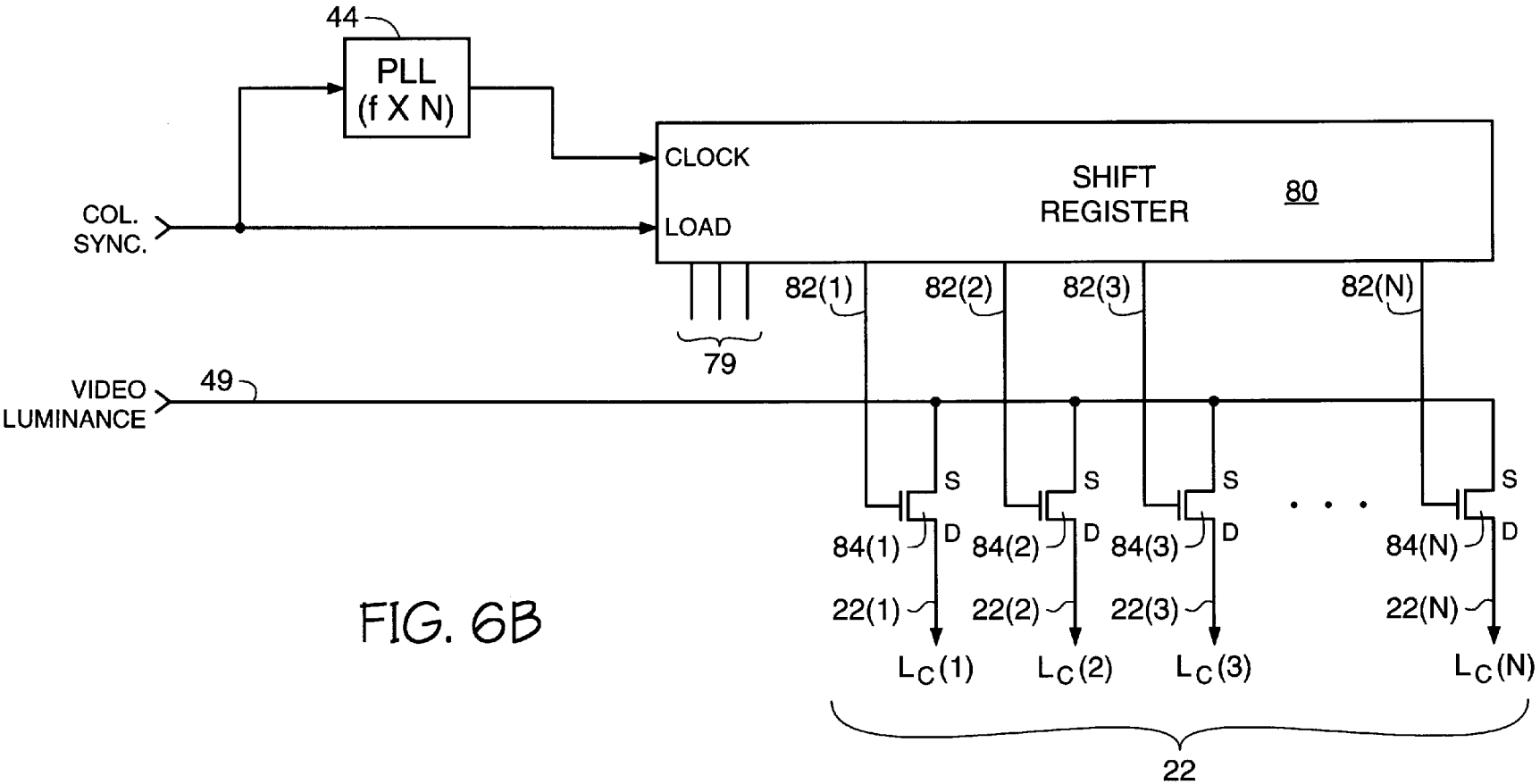

FIG. 6B shows a second, and presently preferred, implementation in which a single shift register 80 replaces the counter 46 and 1-in-N decoder 81 of the FIG. 6A implementation. As in the circuits of FIGS. 3 and 6A, a conventional phase locked loop (PLL) 44 receives the Column Sync signal and produces a Column Clock periodic pulse train signal whose period equals the time in which the received video signal scans from one column to the next column within a row. If the horizontal retrace time is zero, then the Column Clock signal has a frequency N times that of the Column Sync signal, where N is the number of columns in the display. If the horizontal retrace time is non-zero, the ratio of the Column Clock signal frequency to the Column Sync signal frequency is greater than N, as explained in the earlier description of the FIG. 3 embodiment.

The column clock signal produced by the PLL 44 is connected to the clock input of a conventional shift register 80 having at least N shift register stages 80(1), 80(2), . . . 80(N) with respective output terminals 82(1), 82(2), . . . 82(N), where N is the number of columns. The Column Sync signal is connected to the "load" input of the shift register, so that a logical "one" is shifted into the first shift register stage 80(1) in response to the first column clock pulse following the appearance of a column sync pulse, and every other shift register stage stores a logical "zero". In response to each subsequent column clock pulse, the logical "one" value shifts to the next higher stage. Consequently, at the time the received video signal scans the k-th column in a given row (for any integer k from 1 through N), the k-th shift register output terminal 82(*k*) will have a logical "one" or "high" signal, and the other shift register outputs 82 will have a logical "zero" or "low" signal.

The circuit further includes a number N of transistor switches 84. Transistors 84(1), 84(2), . . . 84(N) have their drain terminals respectively connected to the column luminance lines 22(1), 22(2), . . . 22(N) and their gate terminals respectively connected to the shift register outputs 82(1), 82(2), . . . 82(N). The source terminals of all the transistors 84 are connected to receive the video luminance signal 49.

The operation of the two alternative implementations of FIGS. 6A and 6B is similar. For any integer k from 1 through N, when the k-th decoder output 83(*k*) is high in the FIG. 6A embodiment, or when the k-th shift register output 82(*k*) is high in the FIG. 6B embodiment, the k-th transistor switch 84(*k*) is biased "on" so as to connect the video luminance signal 49 to the k-th column luminance line 22(*k*). Concurrently, each of the other decoder outputs 83 or shift register outputs 82 is low, so that their corresponding transistor switches 84 are biased "off". In the "off" state, each transistor 84 other than the k-th transistor has a very high drain-to-source impedance, thereby isolating all the column luminance lines 22 other than the k-th line 22(*k*) from both the video luminance signal 49 and from all voltages present in the video decoder circuit. In other words, each unselected (i.e., disabled) column luminance line 22 is left in a "floating" state by the high impedance which the turned-off transistor 48 interposes between the column line 22 and the video decoder circuit.

Referring now to the pixel circuit shown in FIG. 2, whenever an individual column line 22(*k*) is enabled (for any k from 1 to N), the gate voltage of each of the M transistors 30(1,*k*), 30(2,*k*), 30(3,*k*), . . . 30(M,*k*) in the k-th display column will be $L_C$(k). This voltage will charge up the intrinsic gate-to-substrate capacitance $C_g$ of each of the M transistors 30(1,*k*), 30(2,*k*), . . . 30(M,*k*), and it will charge up the intrinsic capacitance to ground of the relatively long column line 22(*k*). When the k-th column line 22(*k*) becomes disabled, the above-mentioned intrinsic capacitances will maintain the same gate voltage $L_C$(k) on each of the M transistors 30(1,*k*)–30(M,*k*). If the gate capacitances have sufficiently low leakage current, as would be true for FET's 30 fabricated on a single-crystal silicon substrate, then the gate voltage will be preserved until the next time the k-th column line 22(*k*) is enabled. Consequently, the voltage of the luminance signal $L_C(k)$ is present continuously at the gate of each transistor 30, so that the column scanning rate does not affect the duty cycle of the current through each pixel 12.

Accordingly, the duty cycle of the current through each pixel 12(*i,k*) will be the duty cycle of the row enable signal R*(i) on the row enable line 20(*i*) connected to that pixel. Since M is the number of rows in the display, the duty cycle of each row enable signal is somewhat less than 1/M. (The duty cycle typically is less than 1/M, rather than equal to 1/M, because there is a delay between the time when the i-th row is disabled and the time when the (i+1)-th row is enabled.)

If the intrinsic gate-to-substrate capacitance of the transistors 30 is too leaky to maintain the gate voltage at $L_C(k)$ throughout the period a column line is disabled, a discrete capacitor can be connected between the gate and the substrate, between the gate and the source, or between the gate and any other voltage reference point, such as electrical ground. The capacitor should be large enough that the R-C time constant of the capacitor in combination with any resistances which discharge the capacitor exceeds the duration of one row scan time period, that is, the time period during which a row enable line is enabled.

If there is a delay between the time of the Column Sync pulse and the scanning of the first column as part of a "horizontal retrace" period, in the FIG. 6B embodiment additional stages 79 should be added to the shift register ahead of the first stage 82(1) which controls the first column line 22(1). In the FIG. 6A embodiment, the counter should be programmed to reset to a negative number rather than to zero in response to the Column Sync signal. The number of additional stages or the negative number should be proportional to the duration of such delay, as explained above in the description of the FIG. 3 embodiment.

A more detailed description of a preferred video decoder circuit for extracting synchronization signals from a video signal to control row and column shift registers is in commonly-assigned, copending U.S. patent application Ser. No. 08/372,413, of which the present application is a continuation-in-part, the disclosure of which is hereby incorporated in this application.

An idiosyncrasy of the FIG. 6 embodiments having "floating unselected column lines" or "gated luminance signals" is that the displayed image is rotated or skewed slightly clockwise (assuming columns are scanned from left to right). The reason is that the gate-to-substrate capacitance of the transistor 30(*i*,1) in the first column of the i-th row is charged up to the luminance signal for the i-th row almost immediately after the i-th row is enabled, but the gate capacitance of the transistor 30(*i*,N) in the last column of the i-th row does not receive the luminance signal for the i-th row until near the end of the period the i-th row is enabled. Consequently, during most of the period the i-th row is enabled, the gate voltage of the transistor 30(i,N) equals the luminance signal for the (i−1)-th row. For transistors in intermediate columns, the skewing is proportionately intermediate the extremes of the first and last columns. However, for a typical display having two hundred or more rows, a skewing of one row toward one side of the display is essentially imperceptible.

b. Alternative with Pixel Current Only During Horizontal Retrace

The skewing just described can be eliminated if the i-th inverted row enable line R*(i) is enabled only during the time period after scanning of the i-th row is completed but before scanning of the (i+1)-th row begins. In other words, R*(i) remains disabled (i.e., "high") during the scanning time period of the i-th row during which the column luminance voltage $L_C(k)$ is stored in the gate capacitances of each of the N transistors 30(*i*,1)–30(*i*,N) in the i-th row. After the i-th row has been scanned, so that each of the N transistors 30(*i*,1)–30(*i*,N) has its gate voltage set to its appropriate luminance voltage $L_C$, R*(i) then is enabled (i.e., "low"), and each of the transistors 30(*i*,1)–30(*i*,N) conducts current to its respective emitter tips 18(*i*,1)–30(*i*,N) in proportion to the luminance voltage stored in its respective gate capacitance.

The design described in the preceding paragraph can be implemented by modifying the circuit shown in FIG. 3 for generating the inverted row enable signal R*. Specifically, each of the M inverted row enable signals R*(1)–R*(M) should be logically OR-ed with a signal which is low only during the horizontal retrace period of the display, that is, the period between the completion of scanning one row and the beginning of scanning the next row. In a display complying with the NTSC video standard, the row scan period is 53.2 μs, and the horizontal retrace period is 10.3 μs. Consequently, eliminating the skewing by turning on each pixel only during the horizontal retrace period reduces the maximum duty cycle of the current flow to each pixel from 1/M to about 1/(6M).

In the embodiment described in the preceding section 6. a., it was important for the deselected column lines to "float" both before and after the column luminance voltage was applied to the column line, because the row enable signal R* enabled pixel current to flow during the entire row scan. In the embodiment of the present section 6. b., it is only necessary for a each column line to "float" during the portion of each row scanning period after the column luminance voltage has been applied to that column line. Because the row enable signal R* does not enable pixel current to flow until the end of the row scan, the status of a column line is unimportant before the point in each row scanning period when the column luminance voltage is applied to that column line.

c. Alternative with Buffered Column Luminance Signals

Another possible modification to the column luminance signal generator circuit shown in FIGS. 3 or 4 is to add a buffer register between the column luminance lines 22 and the output of the circuit which generates the column luminance signals (i.e., the output of the demultiplexer 48 in FIG. 3 or the drains of the transistors 84 in FIG. 4). The buffer would store all N of the column luminance signals $L_C$(1)–$L_C$(N) during one row scan interval, and then apply the respective stored signal values to the column luminance lines 22(1)–22(N) during the following row scan interval. Consequently, each column luminance line would be enabled almost 100% of the time, thereby producing the same duty cycle (almost 1/M) as the embodiment described immediately preceding this paragraph in which the unselected column lines are floating.

The present embodiment with a buffer register has the advantage of not requiring the column luminance voltage to be stored in the gate capacitance of the transistors 30, so that the present embodiment works well with transistors fabricated on polysilicon layers having leaky gate capacitances. The embodiment also has the advantages of not exhibiting any slight rotation or skewing of the displayed image, and potentially having better noise immunity by avoiding high impedance, floating conductor lines.

Figure 7:
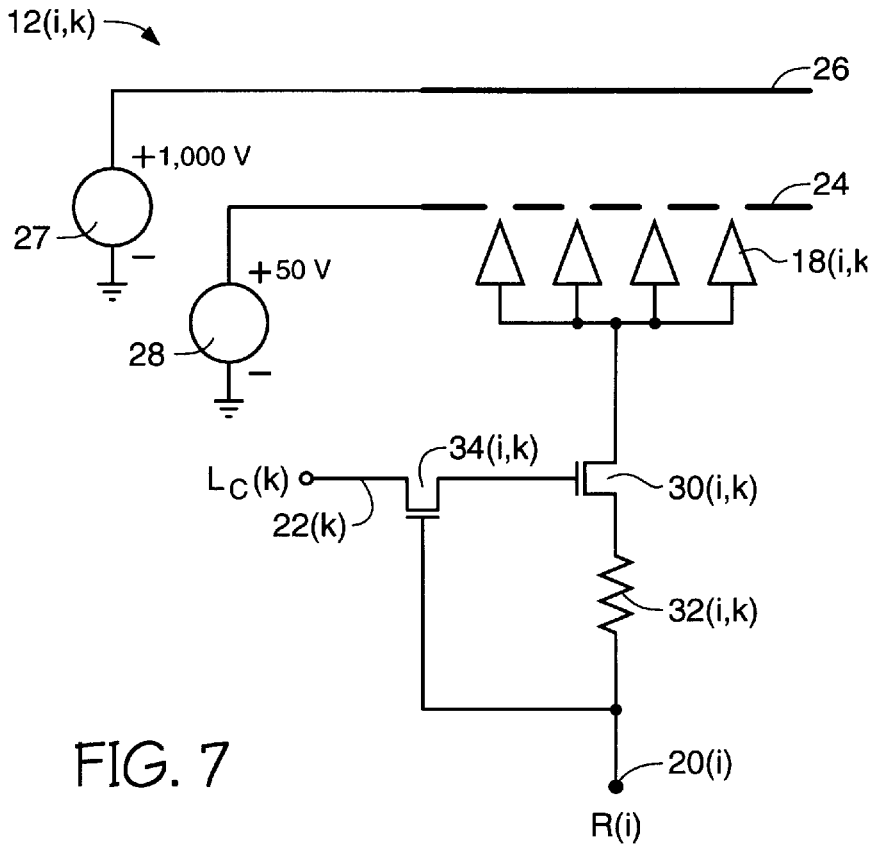
FIG. 7 is an electrical schematic of an alternative pixel current control circuit which enables increasing the duty cycle of the pixel current.
Figure 8:
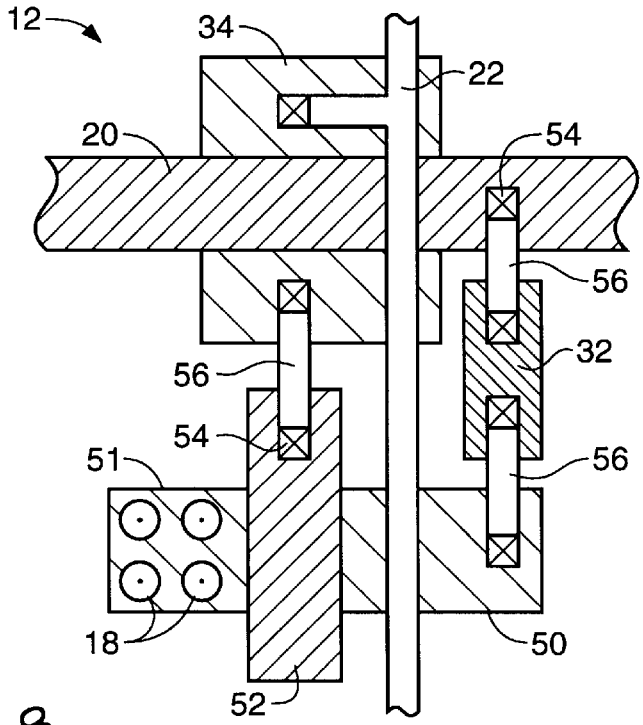
FIG. 8 is a top view of a substrate on which the pixel circuit of FIG. 7 is fabricated.
Figure 9:
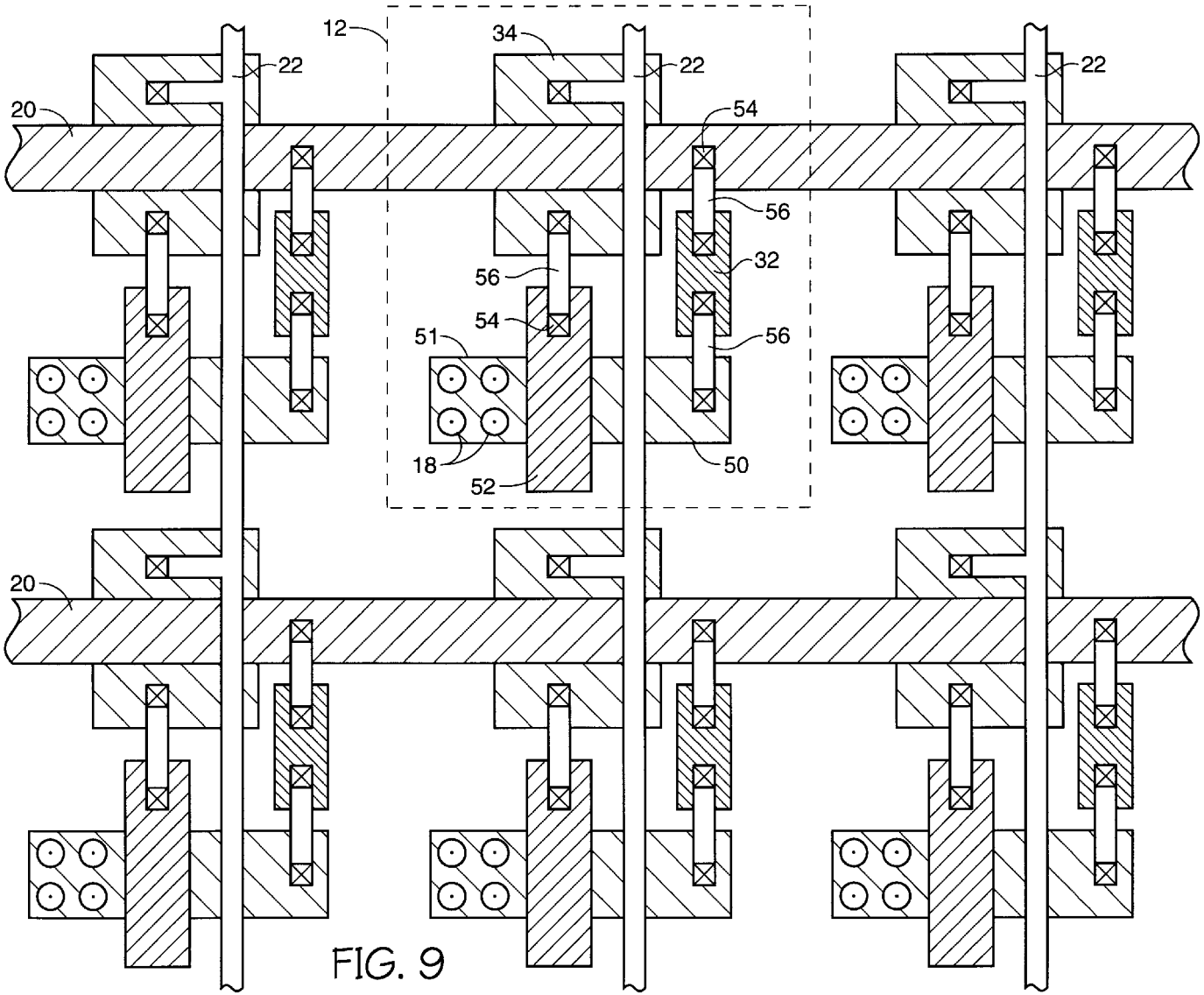
FIG. 9 is a top view of a substrate showing six of the pixels of FIG. 8 and their connections to the inverted row enable line and the column luminance line.

A preferred implementation of a buffer register is disclosed in commonly-assigned U.S. Pat. No. 5,598,156, the entire disclosure of which is hereby incorporated into the present application.

d. Additional Sample-and-Hold Transistor for Almost 100% Duty Cycle FIGS. 7–9 show an alternative design for the pixel circuit 12 which can supply pixel current with a duty cycle of up to (M–1)/M, where M is the number of rows in the display, in contrast with the design of FIGS. 2 and 4 in which the maximum duty cycle is 1/M. This alternative design achieves a high pixel current duty cycle by conducting current to the emitter tips 18 during the time when the corresponding row is disabled, in contrast with the preceding designs in which the pixel current flows during the time when the corresponding row is enabled.

The present alternative design of FIGS. 7–9 differs from the design of FIGS. 2 and 4 in two respects. First, it includes a second field-effect transistor (FET) 34 which performs a sample-and-hold switching function. Second, the row enable signal provided to the pixel circuits is uninverted. Specifically, the row enable signal R(*i*) for the i-th row is high during the scan interval for the i-th row, that is, during the time interval when the values of the N luminance signals $L_C$(1)$L_C$(N) represent the respective brightness values of the pixels 12(*i*,1)–12(*i*,N) in the i-th row.

The operation of the pixel control circuit 12(*i,k*) at the intersection of the i-th row and the k-th column is as follows. During the scan interval for the i-th row, the row enable signal R(*i*) is high, thereby turning off the first transistor 30(*i,k*) so that no current flows to the emitter tips 18(*i,k*). At the same time, the high row enable signal turns on the sample-and-hold transistor 34(*i,k*), which connects the k-th column luminance signal $L_C$(k) to the gate of the first transistor 30(*i,k*). Accordingly, the gate voltage of the first transistor 30(*i,k*) equals the luminance signal $L_C$(k), and the gate-to-substrate capacitance $C_g$ of the first transistor charges up to the voltage of the column luminance signal $L_C$(k).

At the end of the scan interval for the i-th row, the row enable signal R(*i*) drops to its logic "low" voltage, thereby turning off the sample-and-hold transistor 34(*i,k*) so as to disconnect the gate of the first transistor from the column luminance line 22(*k*). Importantly, the gate-to-substrate capacitance $C_g$ of the first transistor retains the charge it stored while the row enable signal was high, thereby maintaining the gate voltage on the first transistor 30(*i,k*) equal to the value of the column luminance signal $L_C$(k) during the most recently completed scan interval for the i-th row.

Additionally, the low voltage of the row enable signal R(*i*) turns on the first transistor 30(*i,k*). The stored voltage $L_C$(k) on the gate of the first transistor controls the current flow to the emitter tips 18(*i,k*) in accordance with the same principles described earlier with respect to the embodiment of FIG. 2. Since the current flow to the emitter tips 18(*i,k*) continues throughout the period the i-th row is disabled, the duty cycle of the emitter tip current is (M–1)/M, where M is the number of rows in the display.

For use with this design of FIGS. 7–9, the video decoder circuit must not cause any of the column luminance signals $L_C$(k) to revert to a "disabled" voltage value (such as zero volts) while any row enable signal R(*i*) is high, because that would discharge the gate capacitance of the first transistor 30(*i,k*) to the "disabled" voltage, thereby erasing the previously stored luminance voltage. Accordingly, while any row enable signal R(*i*) is high, the video decoder circuit either must present a "floating" high-impedance output to each column line 22(*k*) when the decoder is not applying a luminance voltage $L_C$(k) to that column line, as in the "floating" disabled column line embodiment of FIG. 6 described in section 6. a. above, or else the video decoder circuit must include a buffer register which maintains the luminance voltage $L_C$ on each column line throughout the time any row enable signal R(*i*) is high, as in the "buffered" column luminance signal embodiment described in the preceding section 6. c.

The operation of the pixel control circuit design of FIGS. 7–9 is based on storing the luminance voltage $L_C$ in the gate-to-substrate capacitance $C_g$ of the first transistor 30. A minor shortcoming of this design arises because the gate-to-source capacitance $C_{gs}$ also is charged up by the gate voltage $L_C$. The shortcoming is caused by the first transistor's source voltage $V_S$ having one value while $C_{gs}$ is being charged and a different value while current is flowing to the emitter tips. Specifically, the first transistor's source voltage $V_S$ while the gate-to-source capacitance $C_{gs}$ is being charged is the "high" value $R_{(high)}$ of the row enable voltage, and the first transistor's source voltage $V_S$ drops to $(R_{(low)}+L_C-V_T)$ while current is flowing to the emitter tips. Consequently, when the row enable signal transitions from high to low, and the current flow to the emitter tips commences, the drop in voltage at the source side of the gate-to-source capacitance $C_{gs}$ pulls down the gate voltage by an amount equal to the drop in source voltage multiplied by the ratio of the gate-to-substrate capacitance to the gate-to-source capacitance $(C_g/C_{gs})$. Fortunately, our computer simulation of our prototype design indicates that the gate-to-substrate capacitance is several times greater than the gate-to-source capacitance, so that this drop in gate voltage is not significant.

Figure 10:
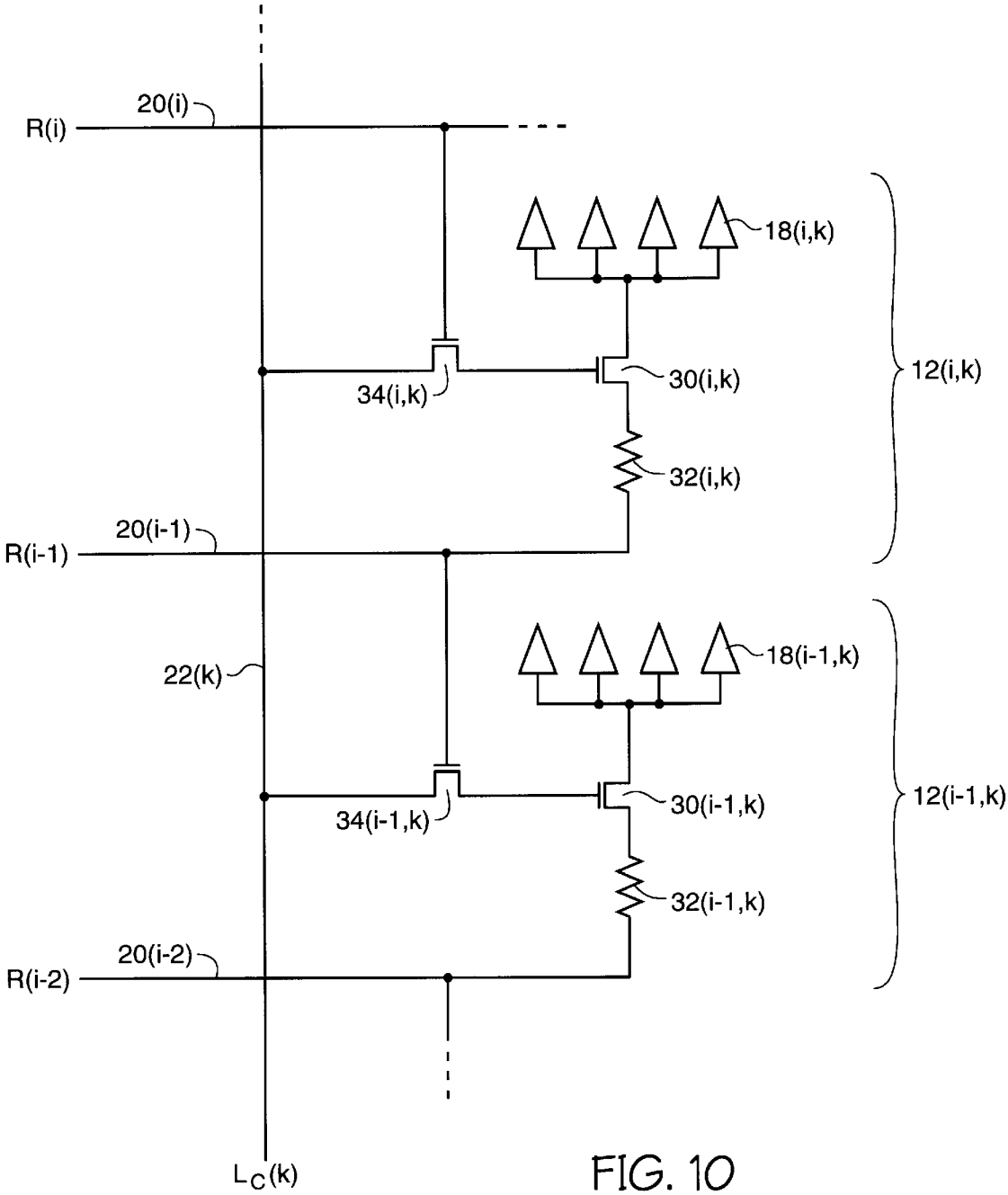
FIG. 10 is an electrical schematic of a modified version of the pixel current control circuit shown in FIG. 7.

FIG. 10 shows a modification of the pixel current control circuit 12 of FIG. 7 which eliminates the drop in gate voltage when the row enable signal transitions from high to low. In the modified design, the gate of the sample-and-hold transistor 34 of each pixel in the i-th row of the display is connected to the i-th row conductor line 20(*i*) as in the FIG. 7 design, but the resistor 32 of each pixel in the i-th display row is connected to a different row conductor line 20, preferably either the (i+1)-th row line 20(i+1) or the (i–1)-th row line 20(i–1), the latter being the embodiment shown in FIG. 10. When R(*i*) is high, sample-and-hold transistor 34(*i,k*) is turned on so as to connect the luminance voltage $L_C$ to the gate-to-substrate and gate-to-source capacitances of the first transistor 30(*i,k*). During this time, R(i–1) is low, so current is flowing to the emitter tips 18(*i,k*), and the voltage $V_S$ at the source of the first transistor 30(*i,k*) is the relatively low value it assumes during current flow to the emitter tips. In other words, the source voltage of the first transistor 30(*i,k*) when the gate-to-source capacitance is being charged up in response to the luminance signal $L_C$ is the same as when current is flowing to the emitter tips 18(*i,k*). This avoids the previously described drop in gate voltage when the row enable signal R(*i*) transitions from high to low.

7. Additional Design Possibilities

The resistor 32 in any of the previously described embodiments need not be a conventional resistor having a linear voltage-current transfer characteristic. Instead, it could be any device having a resistance between two terminals which need not be linear, such as a reverse-biased semiconductor diode. In fact, a non-linear voltage-current transfer characteristic may be desirable to produce a pixel current which is an exponential function of the luminance voltage, so as to approximate the human eye's logarithmic perception of brightness as a function of luminance.

Figure 11:
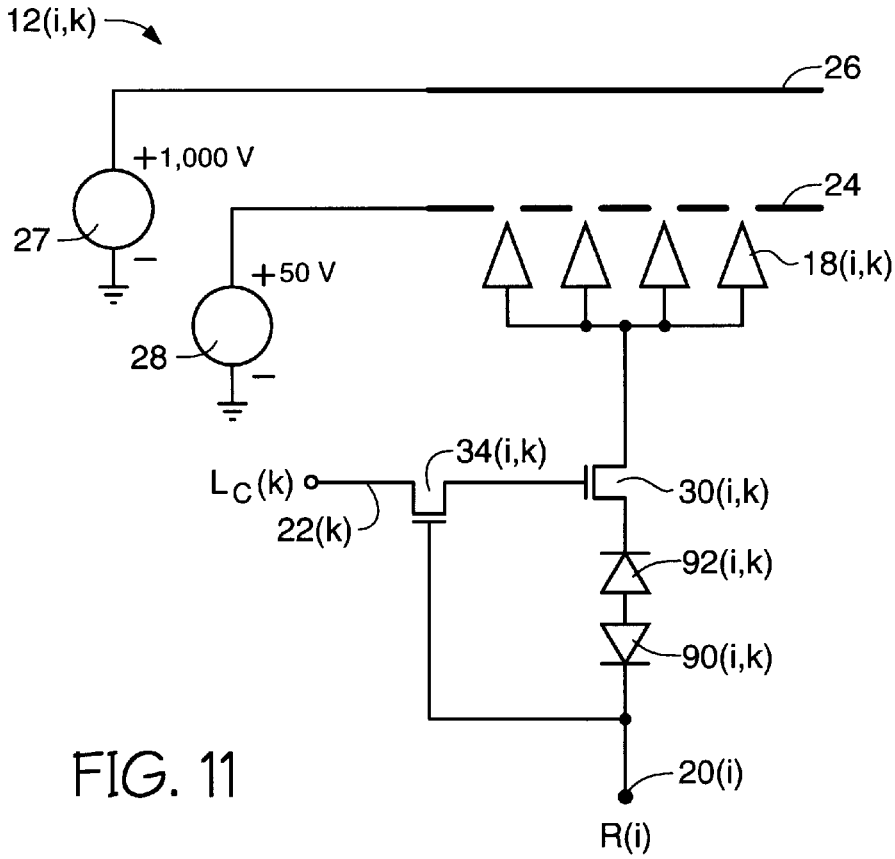
FIGS. 11 and 12 are identical to FIGS. 7 and 8, respectively, except that two diodes connected back-to-back are substituted for the resistor.
Figure 12:
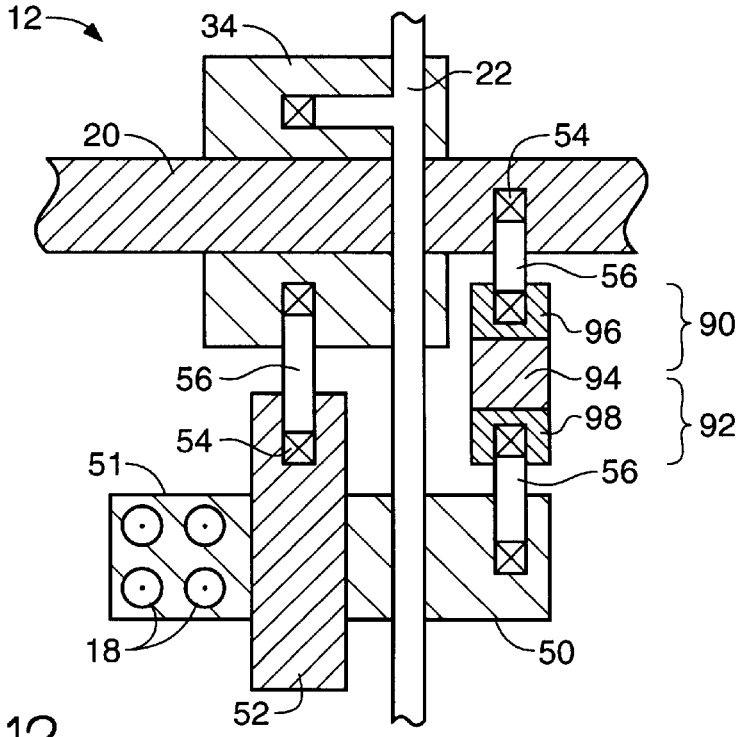

In fact, as shown in FIGS. 11 and 12, the currently preferred embodiment of the invention employs two polysilicon junction diodes 90 and 92 connected in series back-to-back (that is, with their anode terminals connected together) in place of an ordinary resistor 32. The back-to-back diodes have better pixel-to-pixel uniformity of resistance than an ordinary resistor, and have a desirable exponential voltage-current transfer characteristic. The use of back-to-back diodes for current regulation in a pixel p? circuit is described in detail in commonly-assigned U.S. Pat. No. 5,581,159 issued on Dec. 3, 1996 John K. Lee et al., entitled "Back-to-Back Diode Current Regulator for Field Emission Display", the entire contents of which are hereby incorporated by reference into the present application.

To fabricate the back-to-back diodes 90 and 92 in each pixel circuit 12, polysilicon is deposited in region 32 as described in Section 3, above (see FIG. 8). Then, during the subsequent ion implantation step described in Section 3, the central portion 94 of region 32 is lightly P-doped to form the anodes of the two diodes, and the two ends 96, 98 of region 32 (adjacent the two contacts 54) are strongly N-doped to form the respective cathodes of the two diodes 90, 92.

The invention also may be used in a display in which the pixel control circuit 12 connects to the grid electrodes 24, rather than to the emitter tip electrodes 18. In such a display, the respective embodiments shown in FIGS. 2, 7 and 10 would be modified as follows: The transistors would be P-channel rather than N-channel, and the polarity of the voltage source 28 would be reversed. The "high" voltages described for the column luminance signals and the row enable signals would be high amplitude negative voltages, rather than high positive voltages. The grid electrodes 24 and the emitter tip electrodes 18 would be interchanged, so that the grid electrodes would connect to the drain of the first transistor 30, and the emitter tip electrodes would connect to the ungrounded (i.e., negative) terminal of the voltage source 28.

I claim:

1. A field emission display for displaying a plurality of pixels so that each respective pixel has a respective desired luminance, comprising:

(A) a plurality of pixels arranged in a matrix of intersecting rows and columns so that the number of pixels is M times N, where M and N denote the number of rows and columns, respectively, there being one pixel at each intersection of one row and one column, wherein each pixel comprises (1) one or more field emitter tip electrodes, (2) a transistor having a gate, a source, and a drain, the drain being connected to the field emitter tip electrodes, and (3) a resistor having first and second terminals, the first terminal being connected to the source of the transistor;

(B) a plurality of row conductors, the number of row conductors being said number M, wherein for each integer "i" from 1 through M, the i-th row conductor connects to the second terminal of the resistor of each of the pixels in the i-th row;

(C) a plurality of column conductors, the number of column conductors being said number N, wherein for each integer "k" from 1 through N, the k-th column conductor connects to the gate of the transistor of each of the pixels in the k-th column; and (D) a video decoder circuit connected to each of the row and column conductors, wherein the video decoder circuit repeatedly cycles through M successive row scanning periods such that, for each integer "i" from 1 through M, (1) for each integer "k" from 1 through N, during a k-th time interval within the i-th row scanning period the video decoder applies to the k-th column conductor a k-th "luminance" voltage $L_C(k)$, wherein the video decoder establishes the value of the k-th luminance voltage $L_C(k)$ as a function of the desired luminance of the pixel at the intersection of the i-th row and the k-th column, (2) during a portion of the i-th row scanning period, the video decoder applies to the i-th row conductor a voltage having an "enable" value which biases the transistor of each pixel in the i-th row so that said transistor conducts current from the i-th row conductor to the field emitter tip electrodes of that pixel in proportion to the voltage on the gate of said transistor, and (3) during substantially all row scanning periods other than said i-th row scanning period, the video decoder applies to the i-th row conductor a voltage having a "disable" value which biases the transistor of each pixel in the i-th row so that said transistor does not conduct current;

(E) wherein the voltage applied by the video decoder to the row conductors is the only substantial source of electrical power to the field emitter tip electrodes.

2. A display according to claim 1 wherein, for each integer "i" from 1 through M:

said portion of the i-th row scanning period is subsequent to all of said first through N-th time intervals of the i-th row scanning period; and for each integer "k" from 1 through N, during a time period immediately following the k-th time interval of the i-th row scanning period and extending through said portion of the i-th row scanning period, the video decoder interposes between the video decoder and the k-th column conductor an impedance high enough for the column conductor to float at said luminance voltage $L_C(k)$ previously applied to the column conductor by the video encoder during the k-th time interval.

3. A display according to claim 2, wherein said portion of the i-th row scanning period is a horizontal retrace period following said first through N-th time intervals of the i-th row scanning period.

4. A display according to claim 1, further comprising:

a substrate having a first layer which includes the source and drain of each transistor;

a second layer above the first layer which includes the gate of each transistor and the row conductors; and a third layer above the second layer which includes the column conductors.

5. A display according to claim 4, the gates of the transistors and the row conductors are composed of polysilicon, and wherein the column conductors are composed of metal.

6. A display according to claim 1, wherein said portion of the i-th row scanning period includes all of said first through N-th time intervals within the i-th row scanning period.

7. A display according to claim 6, wherein:

said first through N-th time intervals within the i-th row scanning period are concurrent; and the video decoder includes a buffer register for successively receiving, during each row scanning period, luminance signals respectively corresponding to the first through N-th luminance voltages, and for simultaneously applying such luminance voltages to the first through N-th column conductors, respectively, during the subsequent row scanning period.

8. A display according to claim 6, wherein the first through N-th time intervals within the i-th row scanning period are successive.

9. A display according to claim 8 wherein, for each integer "k" from 1 through N, during all time intervals within each row scanning period other than the k-th time interval, the video decoder applies to the k-th column conductor a voltage which biases the transistor of each pixel in the k-th column so as to not conduct current.

10. A display according to claim 6, wherein:

for each integer "k" from 1 through N, during substantially all times other than the k-th time interval of each row scanning period, the video decoder interposes between the video decoder and the k-th column conductor an impedance high enough for the k-th column conductor to float at said luminance voltage $L_C(k)$ previously applied to the k-th column conductor by the video encoder.

11. A display according to claim 1, wherein the video decoder comprises:

a clock circuit for producing a periodic clock signal which includes N clock pulses during each row scanning period; and a demultiplexer circuit having a data input connected to receive an analog luminance signal, having a clock input connected to receive the clock signal, and having N outputs respectively connected to apply said N respective luminance voltages to the N respective column conductors, wherein, for each integer "k" from 1 to N, the demultiplexer circuit couples the analog luminance signal to the k-th column conductor in response to the k-th clock pulse during each row scanning period.

12. A field emission display comprising:

(A) a plurality of pixels arranged in a matrix of intersecting rows and columns so that the number of pixels is M times N, where M and N denote the number of rows and columns, respectively, there being one pixel at each intersection of one row and one column, wherein each pixel comprises (1) one or more field emitter tip electrodes, (2) a first transistor having a gate, a source, and a drain, the drain being connected to the field emitter tip electrodes, (3) a second transistor having a gate, a source, and a drain, the drain of the second transistor being connected to the gate of the first transistor, and (4) a resistor having first and second terminals, the first terminal being connected to the source of the first transistor;

(B) a plurality of row conductors, the number of row conductors being said number M, wherein for each integer "i" from 1 through M, the i-th row conductor connects to the gate of the second transistor of each of the pixels in the i-th row, and wherein the second terminal of each resistor connects to one of the row conductors;

(C) a plurality of column conductors, the number of column conductors being said number N, wherein, for each integer "k" from 1 through N, the k-th column conductor connects to the source of the second transistor of each of the pixels in the k-th column; and (D) a video decoder circuit connected to each of the row and column conductors, wherein the video decoder circuit repeatedly cycles through M successive row scanning periods such that, for each integer "i" from 1 through M, (1) during the i-th row scanning period, the video decoder applies N respective voltages $L_C(1)$ through $L_C(N)$ to the N column conductors such that, for each integer "k" from 1 through N, during a k-th time interval within the i-th row scanning period the video decoder applies to the k-th column conductor a k-th "luminance" voltage $L_C(k)$, wherein the video decoder establishes the value of the k-th luminance voltage $L_C(k)$ as a function of the desired luminance of the pixel at the intersection of the i-th row and the k-th column, (2) during all of said first through N-th time intervals of the i-th row scanning period, the video decoder applies to the i-th row conductor a first voltage which biases the second transistor of each pixel in the i-th row to a conducting state so that the second transistor connects the voltage from the i-th row conductor to the gate of the first transistor, and (3) during row scanning periods other than said i-th row scanning period, the video decoder applies to the i-th row conductor a second voltage, wherein the second voltage biases the second transistor of each pixel in the i-th row to a non-conducting state, and wherein the second voltage biases the first transistor of any pixel to which the i-th row conductor is connected to conduct current in proportion to any voltage at the gate of such first transistor;

(E) wherein the voltage applied by the video decoder to the row conductors is the only substantial source of electrical power to the field emitter tip electrodes.

13. A display according to claim 12, wherein, for each integer "i" from 1 through M, the second terminal of each resistor in the i-th row connects to the i-th row conductor.

14. A display according to claim 12, wherein, for each integer "i" from 1 through M, the second terminal of each resistor in the i-th row connects to a row conductor other than the i-th row conductor.

15. A display according to claim 14, wherein, for each integer "i" from 2 through M, the second terminal of each resistor in the i-th row connects to the (i-1)-th row conductor.

16. A display according to claim 14, wherein, for each integer "i" from 1 through (M–1), the second terminal of each resistor in the i-th row connects to the (i+1)-th row conductor.

17. A display according to claim 12, wherein:

said first through N-th time intervals within the i-th row scanning period are concurrent; and the video decoder includes a buffer register for successively receiving, during each row scanning period, luminance signals respectively corresponding to the first through N-th luminance voltages, and for simultaneously applying such luminance voltages to the first through N-th column conductors, respectively, during the subsequent row scanning period.

18. A display according to claim 12, wherein:

within each row scanning period, the first through N-th time intervals within said row scanning period are successive; and for each integer "k" from 1 through N, during said time intervals within each row scanning period subsequent to the k-th time interval, the video decoder interposes between the video decoder and the k-th column conductor an impedance high enough for the k-th column conductor to float at said luminance voltage $L_C(k)$ previously applied to the k-th column conductor by the video encoder during the k-th time interval.

19. A display according to claim 12, further comprising:

a substrate having a fir layer which includes the source and drain of each transistor;

a second layer above the first layer which includes the gate of each transistor and the row conductors; and a third layer above the second layer which includes the column conductors.

20. A display according to claim 19, wherein the gates of the transistors and the row conductors are composed of polysilicon, and wherein the column conductors are composed of metal.

21. A field emission display comprising:

a substrate including a plurality of field emitter tips arranged in a matrix of intersecting rows and columns, there being at each intersection of one row and one column a number of field emitter tips corresponding to one pixel;

a first layer on the substrate including a first plurality of transistor channels, wherein each transistor channel includes a drain and a source, and wherein each transistor drain connects to the field emitter tips of a corresponding one of the pixels;

a second layer above the first layer, wherein the second layer includes a first plurality of transistor gates respectively overlying the respective transistor channels, and a plurality of row conductors wherein each row conductor is associated with one of the rows of pixels and connects to the sources of the transistors connected to the field emitter tips in said one row; and a third layer above the second layer, wherein the third layer includes a plurality of column conductors so that each column conductor is associated with one of the columns of field emitter tips connects to the gates of the transistors connected to the field emitter tips in said one column.

22. A display according to claim 21, wherein:

the transistor gates and the row conductors of the second layer are composed of polysilicon; and the column conductors of the third layer are composed of metal.

23. A display according to claim 21, further comprising:

a plurality of resistors within one of said layers, each resistor being connected between the source of a corresponding one of the transistors and the row conductor corresponding to said one transistor, so that said connection between said one transistor and its corresponding row conductor is through said resistor.

24. A display according to claim 21, further comprising:

a second plurality of transistor channels in the first layer, each channel of the second plurality being connected between a respective one of the first plurality of transistor gates and the column conductor corresponding to said gate, so that said connection between said transistor gate and its corresponding column conductor is through said transistor channel.

25. A method of fabricating a field emission display, comprising the steps of:

fabricating on a substrate a plurality of field emitter pixels arranged in a matrix of intersecting rows and columns, there being one field emitter pixel at each intersection of one row and one column, wherein each field emitter pixel includes a number of field emitter tips;

fabricating in a first layer on the substrate a first plurality of transistor channels, wherein each transistor channel includes a drain and a source, and wherein each transistor drain connects to the field emitter tips in a corresponding one of the field emitter pixels;

fabricating a second layer above the first layer, including the steps of fabricating in the second layer a first plurality of transistor gates respectively overlying the respective transistor channels, and fabricating in the second layer a plurality of row conductors so that each row conductor is associated with one of the rows of pixels and connects to the sources of the transistors connected to the field emitter tips in said one row; and fabricating in a third layer above the second layer a plurality of column conductors so that each column conductor is associated with one of the columns of pixels and connects to the gates of the transistors connected to the field emitter tips in said one column.

26. A method according to claim 25, wherein:

the step of fabricating the second layer comprises fabricating the transistor gates and the row conductors of polysilicon; and the step of fabricating the third layer comprises fabricating the column conductors of metal.

27. A method according to claim 25, further comprising the step of:

fabricating in one of said layers a plurality of resistors, each resistor being connected between the source of a corresponding one of the transistors and the row conductor corresponding to said one transistor, so that said connection between said one transistor and its corresponding row conductor is through said resistor.

28. A method according to claim 25, further comprising the step of:

fabricating in the first layer a second plurality of transistor channels and connecting each channel of the second plurality between a respective one of the first plurality of transistor gates and the column conductor corresponding to said gate, so that said connection between said transistor gate and its corresponding column conductor is through said transistor channel.

29. A field emission display for displaying a plurality of pixels so that each respective pixel has a respective desired luminance, comprising:

a plurality of pixels arranged in a matrix of intersecting rows and columns so that the number of pixels is M times N, where M and N denote the number of rows and columns, respectively, there being one pixel at each intersection of one row and one column, wherein each pixel comprises a first group of one or more field emitter tip electrodes, a second group of one or more grid electrodes, and a control circuit having an input and an output, wherein the output is connected to supply an electrical output signal to one of said two groups of electrodes of the pixel, and wherein the control circuit controls the value of said output signal in response to an electrical input signal received at the input;

a plurality of column conductors, the number of column conductors being said number N, wherein, for each integer "k" from 1 through N, the k-th column conductor is connected to the input of the control circuit of every pixel in the k-th column; and a video decoder circuit connected to each of the row and column conductors, wherein the video decoder circuit repeatedly cycles through M successive row scanning periods such that, for each integer "i" from 1 through M, and for each integer "k" from 1 through N:

during a k-th time interval within the i-th row scanning period the video decoder applies to the k-th column conductor a k-th "luminance" voltage $L_C(k)$, wherein the video decoder establishes the value of the k-th luminance voltage $L_C(k)$ as a function of the desired luminance of the pixel at the intersection of the i-th row and the k-th column, and during a time period immediately subsequent to and longer than said k-th time interval, the video decoder interposes between the video decoder and the k-th column conductor an impedance high enough so that the k-th column conductor floats at said luminance voltage $L_C(k)$.

30. A display according to claim 29, wherein the video decoder comprises:

a clock circuit for producing a periodic clock signal which includes N clock pulses during each row scanning period;

a logic circuit having a clock input connected to receive the clock signal and having N outputs wherein, for each integer "k" from 1 to N, the logic circuit produces during each row scanning period a logical "enable" output signal at the k-th output of the logic circuit in response to the k-th clock pulse during said row scanning period; and N transistors each having a source, a drain, and a gate, wherein the source of each transistor is connected to receive an analog luminance signal, for each integer "k" from 1 to N, the drain of the k-th transistor is connected to the k-th column conductor, and for each integer "k" from 1 to N, the gate of the k-th transistor is connected to the k-th output of the logic circuit.

31. A display according to claims 29, wherein the control circuit of each pixel comprises:

a transistor having a gate, a source, and a drain;

wherein the gate connects to the column conductor that is connected to the input of said control circuit; and wherein the drain connects to said one group of electrodes that is connected to the output of said control circuit.

32. A field emission display for displaying a plurality of pixels so that each respective pixel has a respective desired luminance, comprising:

a plurality of pixels arranged in a matrix of intersecting rows and columns so that the number of pixels is M times N, where M and N denote the number of rows and columns, respectively, there being one pixel at each intersection of one row and one column, wherein each pixel comprises a first group of one or more field emitter tip electrodes, a second group of one or more grid electrodes, and a control circuit having an input and an output, wherein the output is connected to supply an electrical output signal to one of said two groups of electrodes of the pixel, and wherein the control circuit controls the value of said output signal in response to an electrical input signal received at the input;

a plurality of column conductors, the number of column conductors being said number N, wherein, for each integer "k" from 1 through N, the k-th column conductor is connected to the input of the control circuit of every pixel in the k-th column; and a video decoder circuit connected to each of the row and column conductors, wherein the video decoder circuit repeatedly cycles through M successive row scanning periods such that, for each integer "i" from 1 through M, and for each integer "k" from 1 through N:

during a k-th time interval within the i-th row scanning period the video decoder applies to the k-th column conductor a k-th "luminance" voltage $L_C(k)$, wherein the video decoder establishes the value of the k-th luminance voltage $L_C(k)$ as a function of the desired luminance of the pixel at the intersection of the i-th row and the k-th column, and during a time period immediately subsequent to and longer than said k-th time interval, the video decoder interposes between the video decoder and the k-th column conductor an impedance high enough so that the k-th column conductor floats at said luminance voltage $L_C(k)$;

wherein, for each integer "k" from 1 through N, the k-th column conductor is coupled to a capacitance whose value is sufficient, in combination with said high impedance interposed between the video decoder and the k-th column conductor, so that, after the k-th time interval of each row scanning period, the k-th column conductor floats at said luminance voltage $L_C(k)$ during a time period longer than said k-th time interval.

33. A display according to claim 32, wherein:

the capacitance coupled to the k-th column conductor comprises intrinsic capacitance of the k-th column conductor.

34. A display according to claim 32, wherein:

said one group of electrodes of each pixel is the first group of one or more field emitter tip electrodes of said pixel;

the control circuit of each pixel further comprises a transistor having a gate, a source, and a drain, the gate being connected to the column conductor that is connected to the input of said control circuit, and the drain being connected to said first group of field emitter tip electrodes that is connected to the output of said control circuit;

the display further comprises a plurality of row conductors, the number of row conductors being said number M, wherein, for each integer "i" from 1 through M, the i-th row conductor connects to the source of the transistor of each pixel in the i-th row;

the display further comprises an electrical current source connected to the row conductors, wherein, for each integer "i" from 1 through M, the electrical current source supplies current to the i-th row conductor only during a time period which begins after the N-th time interval of the i-th row scanning period and which ends before the first time interval of the following row scanning period; and for each integer "k" from 1 through N, said capacitance coupled to the k-th column conductor is sufficient, in combination with said high impedance interposed between the video decoder and the k-th column conductor, to maintain said luminance voltage $L_C(k)$ on the k-th column conductor from the end of the k-th time interval of one row scanning period to the end of said one row scanning period.

35. A display according to claim 34, wherein:

each of the transistors has a gate capacitance; and the capacitance coupled to the k-th column conductor comprises the gate capacitance of each of the transistors in the k-th column.

36. A display according to claim 32, wherein:

said one group of electrodes of each pixel is the first group of one or more field emitter tip electrodes of said pixel;

the control circuit of each pixel further comprises a transistor having a gate, a source, and a drain, the gate being connected to the column conductor that is connected to the input of said control circuit, and the drain being connected to said first group of field emitter tip electrodes that is connected to the output of said control circuit;

the display further comprises a plurality of row conductors, the number of row conductors being said number M, wherein, for each integer "i" from 1 through M, the i-th row conductor connects to the source of the transistor of each pixel in the i-th row;

the display further comprises an electrical current source connected to the row conductors, wherein, for each integer "i" from 1 through M, the electrical current source supplies current to the i-th row conductor during most of the i-th row scanning period and does not supply current to the i-th row conductor during times other than the i-th row scanning period; and for each integer "k" from 1 through N, said capacitance coupled to the k-th column conductor is sufficient, in combination with said high impedance interposed between the video decoder and the k-th column conductor, to maintain said luminance voltage $L_C(k)$ on the k-th column conductor throughout a time period equal to the duration of one row scanning period.

37. A method of operating a field emission display so that each pixel in the display has a respective desired luminance, comprising the steps of:

providing a plurality of pixels, wherein each pixel comprises a first group of one or more field emitter tip electrodes, a second group of one or more grid electrodes, and a control circuit having an input and an output;

each control circuit supplying at its output an electrical output signal having a value responsive to an electrical input signal received at its input;

in each pixel, connecting the output of the control circuit of the pixel to one of said two groups of electrodes of the pixel;

arranging the pixels in a matrix of intersecting rows and columns so that the number of pixels is M times N, where M and N denote the number of rows and columns, respectively, there being one pixel at each intersection of one row and one column;

providing a plurality of column conductors, the number of column conductors being said number N;

for each integer "k" from 1 through N, connecting the k-th column conductor to the input of the control circuit of every pixel in the k-th column;

repeatedly cycling through M successive row scanning periods; and for each integer "i" from 1 through M, and for each integer "k" from 1 through N:

during a k-th time interval within the i-th row scanning period, applying to the k-th column conductor a k-th "luminance" voltage having a value $L_C(k)$ which is a function of the desired luminance of the pixel at the intersection of the i-th row and the k-th column, and during a time period immediately subsequent to and longer than said k-th time interval, interposing between the video decoder and the k-th column conductor an impedance high enough so that the k-th column conductor floats at said luminance voltage $L_C(k)$.

38. A method according to claim 37, wherein:

the step of providing in each pixel a control circuit comprises the steps of providing in said pixel a transistor having a gate and a channel, and connecting the drain of the transistor to the field emitter tip electrodes of said pixel; and the step of connecting the k-th column conductor to the input of the control circuit of every pixel in the k-th column comprises the step of for each integer "k" from 1 through N, connecting the k-th column conductor to the gate of the transistor of every pixel in the k-th column.

39. A method of operating a field emission display so that each pixel in the display has a respective desired luminance, comprising the steps of:

providing a plurality of pixels, wherein each pixel comprises a first group of one or more field emitter tip electrodes, a second group of one or more grid electrodes, and a control circuit having an input and an output;

each control circuit supplying at its output an electrical output signal having a value responsive to an electrical input signal received at its input;

in each pixel, connecting the output of the control circuit of the pixel to one of said two groups of electrodes of the pixel;

arranging the pixels in a matrix of intersecting rows and columns so that the number of pixels is M times N, where M and N denote the number of rows and columns, respectively, there being one pixel at each intersection of one row and one column;

providing a plurality of column conductors, the number of column conductors being said number N;

for each integer "k" from 1 through N, connecting the k-th column conductor to the input of the control circuit of every pixel in the k-th column;

repeatedly cycling through M successive row scanning periods;

for each integer "i" from 1 through M, and for each integer "k" from 1 through N:

during a k-th time interval within the i-th row scanning period, applying to the k-th column conductor a k-th "luminance" voltage having a value $L_C(k)$ which is a function of the desired luminance of the pixel at the intersection of the i-th row and the k-th column, and during a time period immediately subsequent to and longer than said k-th time interval, interposing between the video decoder and the k-th column conductor an impedance high enough so that the k-th column conductor floats at said luminance voltage $L_C(k)$; and for each integer "k" from 1 through N, coupling to the k-th column conductor a capacitance whose value is sufficient, in combination with said high impedance interposed between the video decoder and the k-th column conductor, so that, after the k-th time interval of each row scanning period, the k-th column conductor floats at said luminance voltage $L_C(k)$ during a time period longer than said k-th time interval.

40. A method according to claim 39, wherein:

the capacitance coupled to the k-th column conductor comprises intrinsic capacitance of the k-th column conductor.

41. A method according to claim 39, further comprising the steps of:

providing a plurality of row conductors, the number of row conductors being said number M; and for each integer "i" from 1 through M, supplying electrical current to the i-th row conductor only during a time period that begins after the N-th time interval of the i-th row scanning period and that ends before the first time interval of the following row scanning period;

wherein said one group of electrodes of each pixel is said first group of one or more field emitter tip electrodes of said pixel;

wherein the step of providing in each pixel a control circuit further comprises the steps of providing in each pixel a transistor having a gate, a source, and a drain, connecting the gate of the transistor of each pixel to the column conductor that is connected to the input of the control circuit of said pixel, connecting the drain of the transistor of each pixel to the field emitter tip electrodes of said pixel, and for each integer "i" from 1 through M, connecting the i-th row conductor to the source of the transistor of each pixel in the i-th row; and wherein, for each integer "k" from 1 through N, the capacitance coupled to the k-th column conductor has a value sufficient, in combination with said high impedance interposed between the video decoder and the k-th column conductor, to maintain said luminance voltage $L_C(k)$ on the k-th column conductor from the end of the k-th time interval of one row scanning period to the end of said one row scanning period.

42. A method according to claim 39, further comprising the steps of:

providing a plurality of row conductors, the number of row conductors being said number M; and for each integer "i" from 1 through M, supplying electrical current to the i-th row conductor during most of the i-th row scanning period and not supplying current to the i-th row conductor during times other than the i-th row scanning period;

wherein said one group of electrodes of each pixel is said first group of one or more field emitter tip electrodes of said pixel;

wherein the step of providing in each pixel a control circuit further comprises the steps of providing in each pixel a transistor having a gate, a source, and a drain, connecting the gate of the transistor of each pixel to the column conductor that is connected to the input of the control circuit of said pixel, connecting the drain of the transistor of each pixel to the field emitter tip electrodes of said pixel, and for each integer "i" from 1 through M, connecting the i-th row conductor to the source of the transistor of each pixel in the i-th row; and wherein, for each integer "k" from 1 through N, the capacitance coupled to the k-th column conductor has a value sufficient, in combination with said high impedance interposed between the video decoder and the k-th column conductor, to maintain said luminance voltage $L_C(k)$ on the k-th column conductor throughout a time period equal to the duration of one row scanning period.

43. A method according to claim 42, wherein:

each of the transistors has a gate capacitance; and the capacitance coupled to the k-th column conductor comprises the gate capacitance of each of the transistors in the k-th column.

44. A method of supplying electrical current to each respective pixel of a field emission display through a row conductor and a column conductor connected to that pixel, without the need for connecting additional power conductors to that pixel, so that each respective pixel produces a respective desired luminance, comprising the steps of:

providing a plurality of pixels, wherein each pixel comprises a first group of one or more field emitter tip electrodes, a second group of one or more grid electrodes, a transistor having a gate, a source, and a drain, and a resistor having first and second terminals;

arranging the pixels in a matrix of intersecting rows and columns so that the number of pixels is M times N, where M and N denote the number of rows and columns, respectively, there being one pixel at each intersection of one row and one column;

in each pixel, connecting the drain of the transistor of that pixel to the electrodes in one of said two electrode groups of that pixel;

in each pixel, connecting the first terminal of the resistor of that pixel to the source of the transistor of that pixel;

providing a plurality of row conductors, the number of row conductors being said number M;

for each integer "i" from 1 through M, connecting the i-th row conductor to the second terminal of the resistor of each of the pixels in the i-th row;

providing a plurality of column conductors, the number of column conductors being said number N;

for each integer "k" from 1 through N, connecting the k-th column conductor to the gate of the transistor of each of the pixels in the k-th column;

repeatedly cycling through M successive row scanning periods;

for each integer "i" from 1 through M, and for each integer "k" from 1 through N, during a k-th time interval within the i-th row scanning period, applying to the k-th column conductor a k-th luminance voltage having a value $L_C(k)$ which is a function of the desired luminance of the pixel at the intersection of the i-th row and the k-th column;

for each integer "i" from 1 through M, during a portion of the i-th row scanning period, applying to the i-th row conductor a voltage having an "enable" value which biases the transistor of each pixel in the i-th row so that said transistor conducts current from the i-th row conductor to the electrodes of that pixel in proportion to the voltage on the gate of said transistor; and for each integer "i" from 1 through M, during substantially all row scanning periods other than said i-th row scanning period, applying to the i-th row conductor a voltage having a "disable" value which biases the transistor of each pixel in the i-th row so that said transistor does not conduct current;

wherein said voltage having an "enable" value applied to the row conductors is the only substantial source of electrical power to the electrodes in said one of the two groups of electrodes.

45. A method according to claim 44, further comprising the step of:

for each integer "k" from 1 through N, during time intervals within each row scanning period following the k-th time interval, disconnecting the k-th column conductor from any source of voltage so that the k-th column conductor floats at said luminance voltage $L_C(k)$;

wherein, for each integer "i" from 1 through M, said portion of the i-th row scanning period is subsequent to all of said first through N-th time intervals within the i-th row scanning period.

46. A method according to claim 45, wherein said portion of the i-th row scanning period is a horizontal retrace period following said first through N-th time intervals of the i-th row scanning period.

47. A method according to claim 44, wherein said portion of the i-th row scanning period includes all of said first through N-th time intervals within the i-th row scanning period.

48. A method according to claim 47, wherein the step of applying a luminance voltage $L_C(k)$ to the k-th column conductor comprises the steps of:

successively receiving, during each row scanning period, luminance signals respectively corresponding to the first luminance voltage $L_C(1)$ through the N-th luminance voltage $L_C(N)$; and during the subsequent row scanning period, simultaneously applying said first through N-th luminance voltages to the first through N-th column conductors, respectively;

wherein each of said first through N-th time intervals within the i-th row scanning period are concurrent.

49. A method according to claim 47, further comprising the step of:

for each integer "k" from 1 through N, during time intervals within each row scanning period following the k-th time interval, disconnecting the k-th column conductor from any source of voltage so that the k-th column conductor floats at said luminance voltage previously applied to the k-th column conductor during the k-th time interval;

wherein the step of applying said voltage having a "disable" value comprises the step of, for each integer "k" from 1 through N, during all time intervals other than the k-th time interval within each row scanning period, applying to the k-th column conductor a voltage which biases the transistor of each pixel in the k-th row so as to not conduct current; and wherein the first through N-th time intervals within the i-th row scanning period are successive.

50. A method of supplying electrical current to each respective pixel of a field emission display through a row conductor and a column conductor connected to that pixel, without the need for connecting additional power conductors to that pixel, so that each respective pixel produces a respective desired luminance, comprising the steps of:

providing a plurality of pixels, wherein each pixel comprises a first group of one or more field emitter tip electrodes, a second group of one or more grid electrodes, a first transistor having a gate, a source, and a drain, a second transistor having a gate, a source, and a drain, and a resistor having first and second terminals;

arranging the pixels in a matrix of intersecting rows and columns so that the number of pixels is M times N, where M and N denote the number of rows and columns, respectively, there being one pixel at each intersection of one row and one column;

in each pixel, connecting the drain of the first transistor of that pixel to the electrodes in one of said two electrode groups of that pixel;

in each pixel, connecting the drain of the second transistor of that pixel to the gate of the first transistor of that pixel;

in each pixel, connecting the first terminal of the resistor of that pixel to the source of the first transistor of that pixel;

providing a plurality of row conductors, the number of row conductors being said number M;

for each integer "i" from 1 through M, connecting the i-th row conductor to the gate of the second transistor of each of the pixels in the i-th row;

connecting the second terminal of each resistor to one of the row conductors;

providing a plurality of column conductors, the number of column conductors being said number N;

for each integer "k" from 1 through N, connecting the k-th column conductor to the source of the second transistor of each of the pixels in the k-th column;

repeatedly cycling through M successive row scanning periods;

for each integer "i" from 1 through M, and for each integer "k" from 1 through N, during a k-th time interval within the i-th row scanning period, applying to the k-th column conductor a k-th luminance voltage having a value $L_C(k)$ which is a function of the desired luminance of the pixel at the intersection of the i-th row and the k-th column;

for each integer "i" from 1 through M, during a portion of the i-th row scanning period, which portion includes all of the first through N-th time intervals of the i-th row scanning period, applying to the i-th row conductor a first voltage which biases the second transistor of each pixel in the i-th row to a conducting state so that the second transistor connects the voltage from the i-th row conductor to the gate of the first transistor; and for each integer "i" from 1 through M, during substantially all row scanning periods other than said i-th row scanning period, applying to the i-th row conductor a second voltage, wherein the second voltage biases the second transistor of each pixel in the i-th row to a non-conducting state, and wherein the second voltage biases the first transistor of any pixel to which the i-th row conductor is connected to conduct current in proportion to any voltage at the gate of such first transistor;

wherein said first voltage applied to the row conductors is the only substantial source of electrical power to the electrodes in said one of the two groups of electrodes.

51. A method according to claim 50, wherein the step of connecting the second terminal of each resistor to one of the row conductors comprises:

for each integer "i" from 1 through M, connecting the second terminal of each resistor in the i-th row to the i-th row conductor.

52. A method according to claim 50, wherein the step of connecting the second terminal of each resistor to one of the row conductors comprises:

for each integer "i" from 1 through M, connecting the second terminal of each resistor in the i-th row to a row conductor other than the i-th row conductor.

53. A method according to claim 52, wherein the step of connecting the second terminal of each resistor in the i-th row to a row conductor other than the i-th row conductor comprises:

for each integer "i" from 2 through M, connecting the second terminal of each resistor in the i-th row to the (i-1)-th row conductor.

54. A method according to claim 52, wherein the step of connecting the second terminal of each resistor in the i-th row to a row conductor other than the i-th row conductor comprises:

for each integer "i" from 1 through (M–1), connecting the second terminal of each resistor in the i-th row to the (i+1)-th row conductor.

55. A method according to claim 50, wherein the step of applying a luminance voltage $L_C(k)$ to the k-th column conductor comprises the steps of:

successively receiving, during each row scanning period, luminance signals respectively corresponding to the first luminance voltage $L_C(1)$ through the N-th luminance voltage $L_C(N)$; and during the subsequent row scanning period, simultaneously applying said first through N-th luminance voltages to the first through N-th column conductors, respectively;

wherein each of said first through N-th time intervals within the i-th row scanning period are concurrent.

56. A method according to claim 50, further comprising the step of:

for each integer "k" from 1 through N, during time intervals within each row scanning period other than the k-th time interval, disconnecting the k-th column conductor from any source of voltage so that the k-th column conductor floats at said luminance voltage $L_C(k)$;

wherein, within each row scanning period, the first through N-th time intervals within said row scanning period are successive.

* * * * *